US010648259B2

(12) United States Patent
Santos

(10) Patent No.: US 10,648,259 B2
(45) Date of Patent: May 12, 2020

(54) METHOD AND SYSTEM FOR CONTROLLED DELIVERY OF UNKNOWN FLUIDS

(71) Applicant: SafeKick Americas LLC, Katy, TX (US)

(72) Inventor: Helio Mauricio Ribeiro dos Santos, Reading (GB)

(73) Assignee: SAFEKICK AMERICAS LLC, Katy, TX (US)

( * ) Notice: Subject to any disclaimer, the term of this patent is extended or adjusted under 35 U.S.C. 154(b) by 261 days.

(21) Appl. No.: 15/788,703

(22) Filed: Oct. 19, 2017

(65) Prior Publication Data

US 2019/0120000 A1 Apr. 25, 2019

(51) Int. Cl.

| | |
|---|---|
| ***E21B 21/08*** | (2006.01) |
| ***E21B 21/16*** | (2006.01) |
| ***E21B 33/06*** | (2006.01) |
| ***E21B 43/34*** | (2006.01) |

(52) U.S. Cl.

CPC ..... *E21B 21/08* (2013.01); *E21B 21/16* (2013.01); *E21B 33/06* (2013.01); *E21B 43/34* (2013.01)

(58) Field of Classification Search

CPC ..... E21B 21/08; E21B 21/16; E21B 33/06; E21B 43/34

See application file for complete search history.

(56) References Cited

U.S. PATENT DOCUMENTS

| | | | | |
|---|---|---|---|---|
| 3,552,502 | A * | 1/1971 | Wilson, Sr. | E21B 21/08 175/25 |
| 4,534,235 | A | 8/1985 | Mitcham et al. | |
| 6,391,094 | B2 * | 5/2002 | Ramos | B01D 19/0042 95/248 |
| 7,044,237 | B2 * | 5/2006 | Leuchtenberg | E21B 21/08 175/48 |
| 2008/0060846 | A1 * | 3/2008 | Belcher | E21B 17/042 175/25 |
| 2008/0190668 | A1 * | 8/2008 | Swartout | E21B 21/065 175/207 |

(Continued)

OTHER PUBLICATIONS

International search report of the International Search Authority (USPTO) for PCT international application serial No. PCT/US2018/051836 dated Dec. 12, 2018.

(Continued)

*Primary Examiner* — Daniel P Stephenson

(74) *Attorney, Agent, or Firm* — Basil M. Angelo; Angelo IP

(57) ABSTRACT

The present disclosure relates to methods and systems for controlled delivery of unknown fluids that safely and efficiently removes entrained gas from unknown fluids in the wellbore and/or marine riser. A control system automatically controls one or more choke manifold(s), and optionally the flow rate of one or more mud pump(s), to maximize the safe flow rate of returning unknown fluids to one or more instrumented mud-gas separator(s) without overloading. The control system may receive the state of the one or more instrumented mud-gas separator(s) to manipulate the choke manifold(s), and optionally the one or more mud pump(s) to maximize the safe flow rate of return fluids and expedite the removal of gases.

35 Claims, 9 Drawing Sheets

(56) References Cited

U.S. PATENT DOCUMENTS

| | | | | |
|---|---|---|---|---|
| 2010/0200242 | A1* | 8/2010 | Rodger | E21B 43/34 166/369 |
| 2011/0214882 | A1* | 9/2011 | Santos | E21B 21/08 166/373 |
| 2012/0211234 | A1 | 8/2012 | Wilie et al. | |
| 2012/0318529 | A1* | 12/2012 | Herrold | E21B 43/01 166/375 |
| 2014/0110169 | A1 | 4/2014 | Santos et al. | |
| 2015/0040755 | A1 | 2/2015 | Nott | |
| 2019/0120000 | A1* | 4/2019 | Santos | E21B 21/08 |

OTHER PUBLICATIONS

Written Opinion of the International Search Authority (USPTO) for PCT international application serial No. PCT/US2018/051836 dated Dec. 12, 2018.

* cited by examiner

METHOD AND SYSTEM FOR CONTROLLED DELIVERY OF UNKNOWN FLUIDS

BACKGROUND OF THE INVENTION

In drilling operations, a drilling rig is typically used to drill a wellbore to recover oil or gas reserves disposed below the Earth's surface. For safety and other reasons, the driller maintains control of the well by controlling the pressure of the drilling fluid, sometimes referred to as mud, within the wellbore. The driller may control the pressure of the drilling fluid by adjusting one or more of the flow rate of mud that the mud pumps deliver downhole, the rotation rate of the top drive/rotary table that rotate the drill string, and the position and speed of the block during tripping, drilling, stripping, and other well construction operations, as well as through the introduction of weighting agents. The drilling fluid is typically pumped through the interior passage of the drill string, the drill bit, and back to the surface through the annulus between the wellbore and the drill pipe. On the surface, the returning fluids may be processed through a mud-gas separator, a shale shaker, or other fluids system before being recirculated for further use downhole.

To maintain well control, the driller typically maintains the pressure within a safe pressure window bounded by the pore pressure and the fracture pressure. The pore pressure typically refers to the pressure of the fluid (liquid or gas) inside the pores of the rock. If the pressure in the annulus falls below the pore pressure, formation fluids may flow into the wellbore and well control may be lost. The fracture pressure typically refers to the pressure at which the formation hydraulically fractures or cracks and may vary as a function of the depth of the well. If the pressure in the annulus rises above the fracture pressure, wellbore fluids may enter the formation and well control may be lost.

During the drilling of subsea wells, the hydrostatic pressure of the drilling fluid is typically maintained at a pressure higher than the pore pressure as a primary barrier to the influx of formation fluids into the wellbore. A blow-out preventer ("BOP") is typically placed over the wellbore on the subsea surface as a secondary barrier. If during drilling, a zone is encountered where the pore pressure is higher than the fluid pressure inside the wellbore, an influx of formation fluids may be introduced into the wellbore and the marine riser. The formation fluids may include liquids, gases, or combinations thereof. Such an occurrence is commonly referred to as a kick and may occur not only during drilling, but also during completion, work-overs, or interventions.

When a kick is taken, the unknown fluids, which may include some mixture of drilling fluids and/or formation fluids, may decrease the density of the fluid in the wellbore annulus, such that an increasing amount of formation fluids enter the wellbore. In such circumstances, control of the well may be lost due to the breach of the primary barrier. Typically, during drilling operations, the BOP remains open and the return of fluids from the well are directed through a fluid return line to a fluids system on the surface. If the amount of gas is small, the fluids returned under normal drilling operations are directed to the shale shaker. If the amount of gas is higher than an acceptable amount, the fluid return is directed to the mud-gas separator to remove the entrained gases from the fluids. When a kick is unexpectedly taken, as soon as the kick is detected, the BOP is closed, and the fluid return is directed to the mud-gas separator to perform the well control operation and return the well to a safe condition so that drilling can be resumed. Because of the delay in detecting the kick and closing off the BOP, formation fluids may enter the marine riser. The presence of formation fluids containing gas in the marine riser poses substantial risk to the safety of the rig, the crew, and the environment as the riser is typically open to the atmosphere without the possibility of closing it off.

Some rigs are equipped with a device to controllably seal the top of the marine riser. In these rigs, there is typically a fluid return line connecting the riser to the well control choke manifold, which directs fluids to the mud-gas separator. Managed pressure drilling ("MPD") rigs also close the top of the mariner riser, but typically have a separate and dedicated MPD choke manifold. The fluid return line from the marine riser can be routed to the well control manifold or to the MPD choke manifold. And from these manifolds there are fluid lines directing fluid flow into the mud-gas separator. The main purpose of these fluid lines is to route the fluid return believed to be contaminated with gas to the proper equipment on the rig, namely, the mud-gas separator, to safely remove the gas. However, the process of eliminating gas from the wellbore or riser is performed manually by a user controlling the choke manifold as well as other equipment on the rig. The entire operation is conducted at very low flow rates, to avoid overflowing the mud-gas separator and to simplify the manual control of the pressures during the operation. The manual process is inefficient, prone to error and failure, and presents a substantial safety and environmental risk.

BRIEF SUMMARY OF THE INVENTION

According to one aspect of one or more embodiments of the present invention, a drilling system for controlled delivery of unknown fluids includes a blowout preventer comprising a wellbore fluid return line that directs wellbore fluids to a choke manifold, an instrumented mud-gas separator that receives fluids from the choke manifold, where the instrumented mud-gas separator includes a sensor that outputs a sensor signal indicative of a state of the instrumented mud-gas separator, and a control system that inputs the sensor signal from the instrumented mud-gas separator and automatically controls a state of the choke manifold based on the sensor signal to expedite removal of fluids.

According to one aspect of one or more embodiments of the present invention, a method of controlled delivery of unknown fluids includes receiving, by a control system, a sensor signal from an instrumented mud-gas separator, wherein the sensor signal is indicative of a state of the instrumented mud-gas separator and controlling a state of a choke manifold based on the sensor signal.

Other aspects of the present invention will be apparent from the following description and claims.

DETAILED DESCRIPTION OF THE INVENTION

Figure 1:
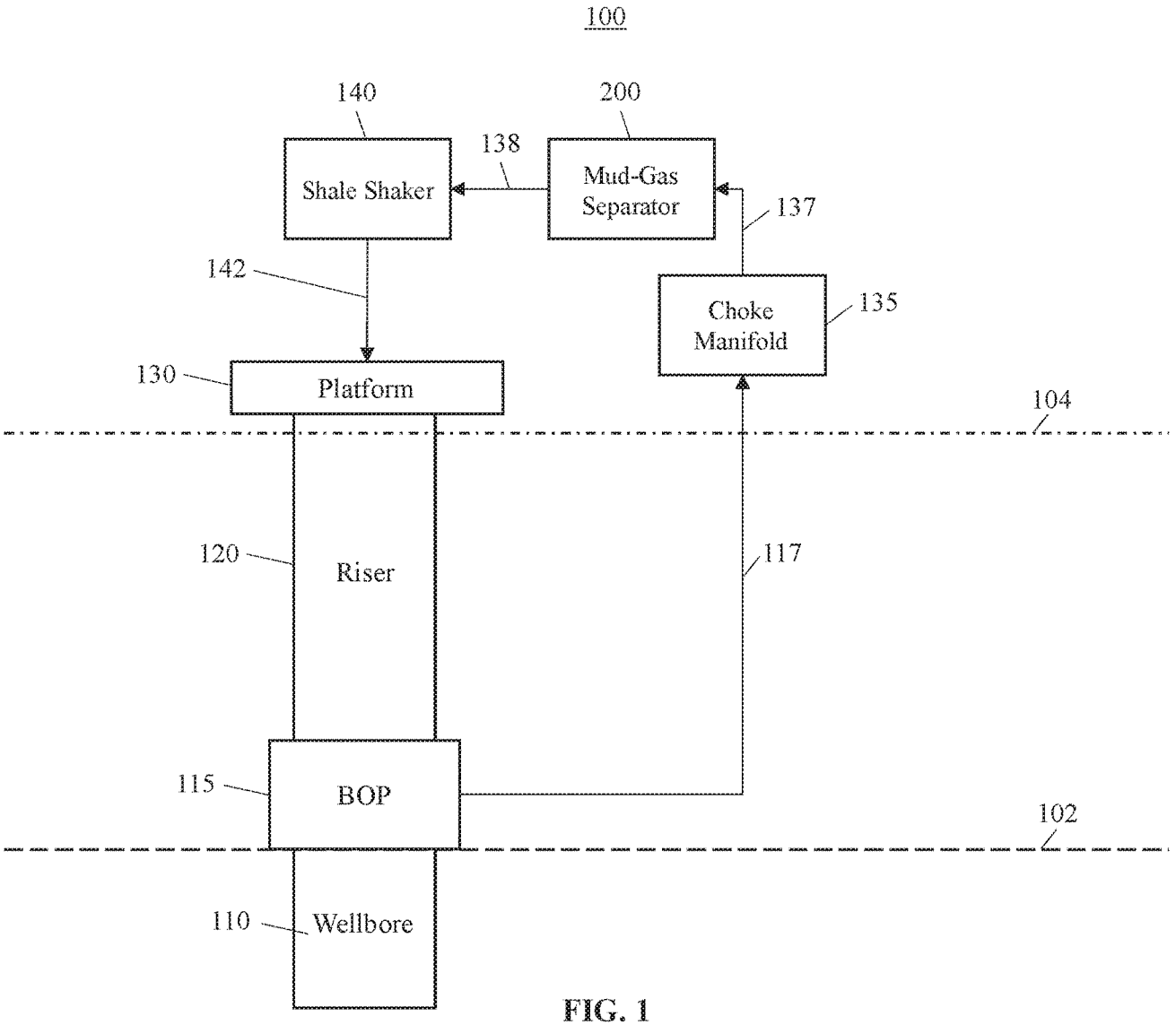
FIG. 1 PRIOR ART
FIG. 1 shows a block diagram of a conventional subsea drilling system.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

In one or more embodiments of the present invention, a method and system for controlled delivery of unknown fluids safely and efficiently removes gas from unknown fluids in the wellbore and/or the marine riser. A control system may automatically control a first choke manifold (typically a well control choke manifold) and/or a second choke manifold (often, but not always, an MPD choke manifold), if any, to maximize the safe flow rate of returning unknown fluids to one or more instrumented mud-gas separator(s) without overloading. The control system may receive the state of the one or more instrumented mud-gas separator(s) to monitor, in real-time, its state and open or close the choke manifold(s) as needed to ensure the maximum safe flow rate of the returning unknown fluids and expedite the safe removal of gas. In addition, the method and system may advise the user to change, or automatically change if so instrumented, the one or more mud pump(s) flow rate based on the operation being conducted and state of the one or more instrumented mud-gas separator(s). Advantageously, the method and system for controlled delivery of unknown fluids significantly reduces the amount of time needed to remove gas from unknown fluids in the wellbore and/or the marine riser and substantially increases the safety of operations.

FIG. 1 shows a block diagram of a conventional subsea drilling system 100. Conventional subsea drilling system 100 may include wellbore 110, BOP 115, marine riser 120, platform 130, and well control choke manifold 135, mud-gas separator 200, and shale shaker 140 disposed on platform 130. Wellbore 110 is the borehole drilled into the subsea ground 102 below waterline 104 that is used to recover oil and gas reserves (not shown) disposed therein. BOP 115 is a mechanical safety device that controllably opens and closes wellbore 110 to prevent blowouts caused by the uncontrolled flow of formation fluids into wellbore 110, such as, for example, when a kick is taken. During drilling operations, BOP 115 is typically opened providing a continuous pathway for the drill string (not shown) and fluids emanating from wellbore 110. Marine riser 120 provides the annular pathway between platform 130 and wellbore 110. Platform 130 is a mobile or fixed structure that extends above the waterline 104 that supports the various machinery and equipment used to drill and operate the well.

Upon detection of an influx of formation fluids (not shown), BOP 115 is closed and the influx of unknown fluids may be directed from BOP 115 to mud-gas separator 200 disposed on platform 130 via a wellbore fluid return line 117 that directs fluid flow to choke manifold 135. Choke manifold 135 is manually manipulated to maintain wellbore 110 pressure and control. To ensure control of the well, returning unknown fluids that are suspected to contain gas are directed through a device intended to separate gases from the expensive drilling fluids, which are typically cleaned, recycled, and reused. Perhaps the most common device of this type is referred to as a mud-gas separator. When there is an unintentional influx of formation fluids suspected to contain gas, mud-gas separator 200 is used to remove the gas during, for example, well kill operations that circulate out the suspected or known kick. The returning unknown fluids may include a mixture of drilling fluids and formation fluids which may be composed of liquids, solids, or gases, or combinations thereof. Typically, BOP 115 is closed as soon as the kick is detected to prevent further undesired fluid flow. The returning fluids from wellbore 110 are directed to mud-gas separator 200 to remove entrained gases from the returning fluids. Once the gases have been removed, the degassed fluids are sent to shale shaker 140 to remove cuttings and solids. The degassed and cleaned fluids may then be recycled for reuse downhole 142.

Figure 2:
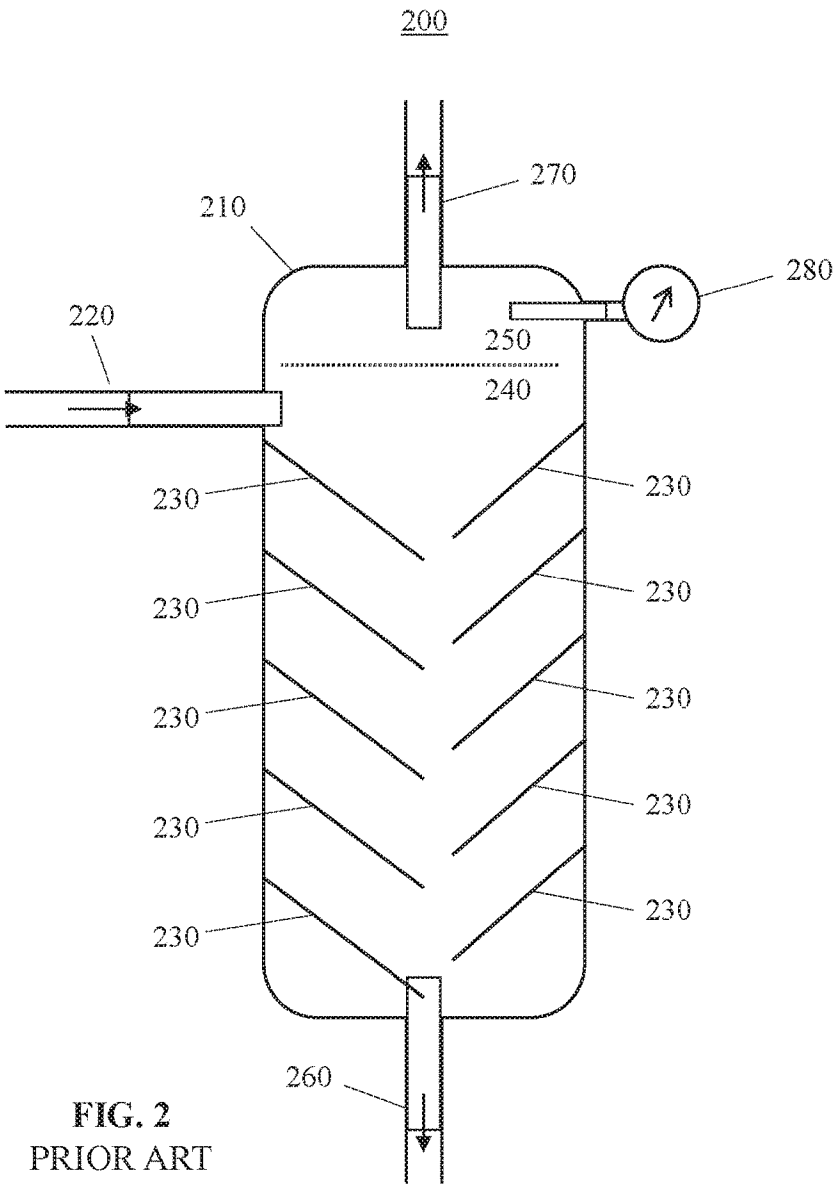
FIG. 2 PRIOR ART
FIG. 2 shows a conventional mud-gas separator.

FIG. 2 shows a conventional mud-gas separator 200. Mud-gas separator 200 includes a vessel 210 having a fluids inlet port 220 that receives return fluids from the choke manifold (135 of FIG. 1), a plurality of baffles 230 that tend to partition the cavity of vessel 210 into a degassed fluids portion 240 and a gas portion 250, a fluids outlet port 260 that directs degassed fluids to, for example, the shale shaker (140 of FIG. 1), a gas vent 270 that vents gases separated from the fluids to the air, and, typically, a gas gauge 280. In operation, the unknown fluids entering mud-gas separator 200 via fluids inlet port 220 typically contains an unknown mixture of liquid, solids, and gases. The input fluids impinge on a series of baffles 230 that are designed to separate the liquid and solids from the gases. The gases then move into gas portion 250 of vessel 210 for venting 270. The degassed fluids are then sent to the shale shaker (140 of FIG. 1) to remove solids and cuttings from the fluids in preparation for recycling and reuse.

While it is generally true that the fluid line directing fluids to inlet port 220 of mud-gas separator 200 contains an adjustable choke manifold (135 of FIG. 1) upstream, this choke manifold (135 of FIG. 1) is used for the sole purpose of manually maintaining wellbore pressure or flow conditions to manage wellbore conditions throughout the flow path upstream of the choke manifold (135 of FIG. 1). However, there are certain events where it may be beneficial to control the mud-gas separator 200 intake 220 in a manner that is largely irrespective of the impact on wellbore pressure or flow conditions upstream of the mud-gas separator 200 or the manually adjustable choke manifold (135 of FIG. 1). One such event occurs when fluids from a deep water marine riser (120 of FIG. 1) are intentionally circulated while the wellbore (110 of FIG. 1) below the bottom of the riser (120 of FIG. 1) is closed off by the BOP (115 of FIG. 1). In such an event, which may be either a normal operational event during which the riser (120 of FIG. 1) fluid density is changed or an unscheduled emergency during which gas that may or may not have inadvertently entered the riser (120 of FIG. 1) prior to closure of the BOP (115 of FIG. 1) is being circulated out, the pressure at the top of the marine riser (120 of FIG. 1) may be permitted to vary from zero to up to 2000 pounds per square inch ("psi") without adverse consequence or unacceptable risk to the marine riser (120 of FIG. 1) or other equipment of the drilling system (100 of FIG. 1).

Given this pressure capability of typical deep water marine risers (120 of FIG. 1), many drilling systems (100 of FIG. 1) in the deep water fleet already have, or may soon be expected to have, equipment, such as an annular closing available at the top of the riser (120 of FIG. 1) that permits the partial or full containment of fluids from the riser (120 of FIG. 1). In particular, systems that permit containment and active control of riser pressure, such as, for example, surface back pressure MPD systems, or some existing riser gas handling systems, permit control or stoppage of the flow of fluids from the riser (120 of FIG. 1) to mud-gas separator 200. However, existing processes used to control or stop the flow of returning fluids from the riser (120 of FIG. 1) are based on practices developed for use during events in which pressure and flow upstream of the choke manifold (135 of FIG. 1) must be much more precisely controlled. As a result, management of riser (120 of FIG. 1) fluid flow during typical operations involves simply permitting flow from the riser (120 of FIG. 1) to remain unimpeded unless or until the processing limits of the mud-gas separator 200 have been, or are expected to be, reached. When that happens, the choke manifold (135 of FIG. 1) is generally used to immediately stop all input to the mud-gas separator 200 until such time that the mud-gas separator 200 functionality is restored and a different, perhaps much slower, throughput may once again be established after the choke manifold (135 of FIG. 1) is fully reopened. This is a very slow process that presents substantially safety risk because of the presence of explosive gas.

As such, there is a long felt, but unsolved need in the industry for a method and system for controlled delivery of unknown fluids that utilizes the current state and condition of the mud-gas separator(s) as a controlling parameter for the upstream choke manifold(s) rather than using pressure or flow conditions upstream of the choke manifold(s) or operator intervention as the primary choke controls. Such a method and system could improve the safety, efficiency, and operational ease when used in appropriate situations, such as, during riser fluid and gas management operations, in which the energy within the riser can be reliably expected to remain below internal riser pressure operational limits (e.g., up to 2000 psi typically), due to either limited internal pressure sources or the presence of independent pressure limiting devices, such as, for example, pressure relief valves, automatic pump shut-off pressure switches, or the like.

In one or more embodiments of the claimed invention, a method and system for controlled delivery of unknown fluids may use the state of an instrumented mud-gas separator(s) as input into a programmable logic controller ("PLC"), programmable logic device ("PLD"), central processing unit ("CPU"), or other programmable device or computing system (e.g., control system 430 of FIG. 4A or FIG. 4B) that may be configured to intelligently, efficiently, and automatically control the one or more choke manifold(s) and optionally the one or more mud pump(s) to respond appropriately to ensure that the instrumented mud-gas separator(s) internal fluid and/or pressure levels are within safe operational limits. If, as frequently occurs, the mud-gas separator(s) are capable of handling, without overload, even a relatively high liquid only flow rate, operators would still be able to use the present invention to facilitate the use of the high flow rate to efficiently manage the return to the rig of riser fluids that either have no, or relatively low concentrations of, free gas without the risk present in conventional solutions, namely, that the sudden and unexpected arrival of higher concentrations of free gas within the mud-gas separator(s) could go unnoticed until after the mud-gas separator(s) are overloaded or otherwise impaired, typically involving a blow-through of a liquid seal, and a high risk condition has suddenly resulted, such as risks derived from either the current dependence on unreliable human detection and intervention, or from dependence on the choke control processes that are focused on control of upstream pressure or flow conditions, parameters that are typically of far less immediate importance if and when a mud-gas separator overload occurs.

While control of fluid flow into the mud-gas separator(s) may appear to be a simple process control task, issues such as potential behavior of gas that may expand between the choke manifold(s) and the mud-gas separator(s), suddenly driving a surge of mud into the mud-gas separator(s) prior to the entrance of the gas, may make control much more difficult, thereby requiring use of choke manifold(s) response logic customized for the specific equipment sizes, locations, flow restrictions, and other aspects that may be present in a given drilling system. Specifically, the choke manifold(s) and/or mud pump(s) response must be sufficiently fast to reliably halt mud-gas separator(s) overload prior to the time that a mud-gas separator reaches its operational limits, which may include either internal pressure or fluid level limits for proper mud-gas separator performance, quality of fluid exiting the mud-gas separator into the hydrostatic seal, presence of $H_2S$, or downstream flow/fluids handling considerations, but not so fast as to lead to an unstable open/close choke and/or start/stop mud pump operation sequence or other condition, such as an abrupt change to pressures upstream of the choke manifold(s), that could cause other procedural issues, control problems, errors, or safety issues.

In certain embodiments of the claimed invention, a gas expansion/flow model may be used to improve throughput without losing the ability to automatically respond and control the instrumented mud-gas separator(s) throughput should worst-case unexpected fluid changes suddenly occur, such as near instantaneous replacement of liquids downstream of the choke manifold(s) with free gas rapidly expanding in the uncontrolled fluid return line feeding into the mud-gas separator(s). In addition to permitting higher safe circulation rates while replacing riser fluids with small, or unknown gas content, such a device could also be beneficial when managing very large riser gas events. While conventional practices suggest that diversion of high rate gas flow to a mud-gas separator would present unacceptable risk, in certain embodiments, that risk would be automatically limited by automatically reducing inflow prior to mud-gas separator failure, operationally triggering other devices, such as, for example, pressure control valves, riser emergency disconnect systems, or simple shut-in to contain gas within the closed riser, when decisions to take such actions have been made in advance and are comprehended by the choke control logic.

Accordingly, in one or more embodiments of the present invention, a method and system for controlled delivery of unknown fluids provides for the controlled delivery of unknown fluids from within the wellbore and/or from within the marine riser in a safe, efficient, and intelligent manner based on the state of the one or more instrumented mud-gas separator(s). Each of one or more instrumented mud-gas separator(s) may include one or more fluid sensor(s) configured to sense the fluid level, threshold crossing, or operational state and/or one or more pressure sensor(s) configured to sense the pressure level, threshold crossing, or operational state within the instrumented mud-gas separator(s) and allow for intelligent control of the one or more choke manifold(s) to prevent swamping, or overloading, as well as underloading the instrumented mud-gas separator(s). Specifically, in certain embodiments, a first choke manifold (typically the well control choke manifold) may govern the delivery of unknown fluids from within the wellbore and the marine riser. In other embodiments, a first choke manifold (typically the well control choke manifold) may govern the delivery of unknown fluids from within the wellbore and a second choke manifold (often, but not always, the MPD choke manifold) may govern delivery of unknown fluids from within the marine riser. A control system may independently or collaboratively control the one or more choke manifold(s) based on the state of the instrumented mud-gas separator(s) and allow for the safe and efficient removal of entrained gases in a way that reduces or eliminates risks posed from human detection, intervention, and other sources of error that give rise to safety issues. In addition to controlling the choke manifold(s), the control system may optionally control one or more mud pump(s), adjusting the flow rate being pumped into the marine riser and the well, based on the state of the instrumented mud-gas separator(s) and the operation being conducted.

Figure 3:
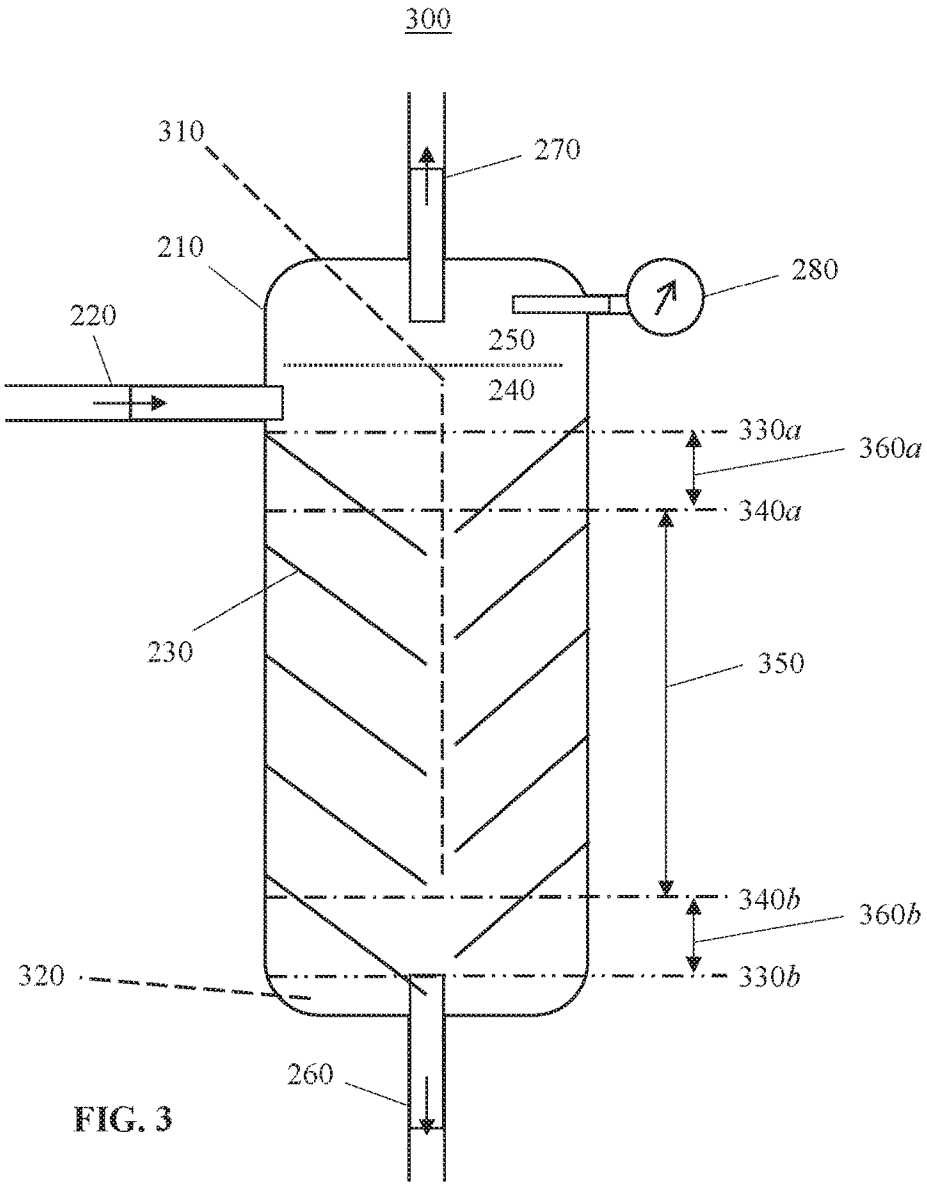
FIG. 3 shows an instrumented mud-gas separator in accordance with one or more embodiments of the present invention.

FIG. 3 shows an instrumented mud-gas separator 300 in accordance with one or more embodiments of the present invention. In certain embodiments, instrumented mud-gas separator 300 may be an existing mud-gas separator (e.g., 200 of FIG. 2) retrofitted and instrumented with one or more fluid sensor(s) 310 that sense the fluid level within the vessel 210, one or more threshold crossings, and/or an operational state and/or one or more pressure sensor(s) 320 that sense the pressure level within the vessel 210, one or more threshold crossings, or an operational state. In other embodiments, the one or more fluid sensor(s) 310 and/or one or more integrated pressure sensor(s) 320 may be integrated into mud-gas separator 300. One of ordinary skill in the art will recognize that an instrumented mud-gas separator 300 may include one or more fluid sensor(s) 310, one or more pressure sensor(s) 320, or combinations thereof in accordance with one or more embodiments of the present invention.

In one or more embodiments of the present invention, fluid sensor 310 may be a float switch sensor, a buoyancy switch sensor, a non-contact ultrasonic sensor, a contact ultrasonic sensor, a capacitance level sensor, a submersible level sensor, a radar level sensor, a time domain reflectometry sensor, combinations thereof, or any other type or kind of sensor capable of sensing the fluid level, one or more threshold crossings, or operational state within the vessel 210. Depending on the type or kind of sensor used, fluid sensor 310 may output a sensor signal (not independently illustrated) indicative of the state of the mud-gas separator 300 including one or more of a fluid level within the vessel 210, the crossing of one or more threshold fluid levels within the vessel 210, or an operational state of the instrumented mud-gas separator 300 to a control system (not shown).

In one or more embodiments of the present invention, pressure sensor 320 may be an absolute pressure sensor, a gauge pressure sensor, a vacuum pressure sensor, a differential pressure sensor, a sealed pressure sensor, a resonant sensor, a thermal sensor, an ionization sensor, a piezoresistive strain gauge, a capacitive sensor, an electromagnetic sensor, a piezoelectric sensor, an optical sensor, a potentiometric sensor, combinations thereof, or any other type or kind of sensor capable of sensing the pressure level, one of more threshold crossings, or operational state within the vessel 210. Depending on the type or kind of sensor used, pressure sensor 320 may output a sensor signal (not independently illustrated) indicative of the state of the mud-gas separator 300 including one or more of a pressure level within the vessel 210, the crossing of one or more threshold pressure levels within the vessel 210, or an operational state of the instrumented mud-gas separator 300 to a control system (not shown).

The output sensor signal(s) (not independently illustrated) from the fluid sensor 310 and/or pressure sensor 320 may be used as input to a control system (e.g., 430 of FIG. 4A or FIG. 4B) that may be configured to intelligently control one or more choke manifold(s) (e.g., 135 of FIG. 4A or FIG. 4B), and optionally one or more mud pump(s) (not shown), that may be manipulated to control delivery of unknown fluids to the one or more instrumented mud-gas separator(s) 300 as discussed in more detail herein. In embodiments where the control system (e.g., 430 of FIG. 4A or FIG. 4B) optionally controls the one or more mud pump(s) (not shown), depending on the type of operation being conducted, the control system (e.g., 430 of FIG. 4A or FIG. 4B) may adjust the flow rate out of the one or more mud pump(s) (not shown) to conduct the operation in the safest, most efficient, and most expedient manner.

In one or more embodiments of the present invention, a critical liquid level maximum 330*a* of instrumented mud-gas separator 300 may be established by a vessel 210 specific level that prevents liquids from being directed to gas vent 270. Similarly, a critical liquid level minimum 330*b* may be established by a vessel 210 specific level that prevents gases from being directed to the shale shaker (140 of FIG. 4A or FIG. 4B). One of ordinary skill in the art will recognize that the critical liquid level maximum 330*a* and minimum 330*b* may be physically constrained by the type or kind of instrumented mud-gas separator 300 and sensor(s) 310 used and may vary based on an application or design in accordance with one or more embodiments of the present invention.

An operational liquid level maximum 340*a* may be established by an offset by a predetermined safety margin from critical liquid level maximum 330*a* that may vary based on an application or design. Similarly, an operational liquid level minimum 340*b* may be established by an offset by a predetermined safety margin from critical liquid level minimum 330*b* that may vary based on an application or design. One of ordinary skill in the art will recognize that the operational liquid level maximum 340*a* and minimum 340*b* may vary based on the type or kind of instrumented mud-gas separator 300 and sensor(s) 310 used and variations in the performance characteristics of upstream and downstream equipment, which may impact how fast actions must be taken to prevent overloading or underloading conditions, in accordance with one or more embodiments of the present invention.

An operational range 350 of instrumented mud-gas separator 300 may be established by the range between the operational liquid level maximum 340*a* and minimum 340*b*. A method and system for controlled delivery of unknown fluids may maximize the flow rate of returning fluids by opening the choke manifold(s) (e.g., 135 of FIG. 4A or FIG. 4B), and potentially changing the flow rate of the one or more mud pump(s) depending on the operation being conducted, while the fluid level is within the operational range 350. In certain embodiments, the maximum flow rate may be established by opening the one or more choke manifold(s) (e.g., 135 of FIG. 4A or FIG. 4B) fully or in a stepwise incremental manner until they are fully opened, while the sensed fluid level (not shown) is within the operational range 350.

An overload prevention range 360*a* of instrumented mud-gas separator 300 may be established by the range between critical liquid level maximum 330*a* and operational liquid level maximum 340*a*. In certain embodiments, the flow rate may be reduced by closing the one or more choke manifold(s) (e.g., 135 of FIG. 4A or FIG. 4B) in a stepwise incremental manner when the sensed fluid level meets or exceeds the operational liquid level maximum 340*a* and continues to approach the critical liquid level maximum 330*a* and fully close the one or more choke manifold(s) (e.g., 135 of FIG. 4A or FIG. 4B) when the sensed fluid level meets or exceeds the critical liquid level maximum 330*a*.

An underload prevention range 360*b* of instrumented mud-gas separator 300 may be established by the range between critical liquid level minimum 330*b* and operational liquid level minimum 340*b*. In certain embodiments, the flow rate may be reduced by closing the one or more choke manifold(s) (e.g., 135 of FIG. 4A or FIG. 4B) in a stepwise incremental manner when the sensed fluid level meets or falls below the operational liquid level minimum 340*b* and continues to approach the critical liquid level minimum 330*b* and fully close the one or more choke manifold(s) (e.g., 135 of FIG. 4A or FIG. 4B) when the sensed fluid level meets or falls below the critical liquid level minimum 330*b*.

In other embodiments, such as those where the one or more mud-gas separator(s) 300 are instrumented with one or more fluid threshold crossing sensor(s) (not shown), the flow rate may be reduced by closing the one or more choke manifold(s) (e.g., 135 of FIG. 4A or FIG. 4B) in a stepwise incremental manner, or fully, when the sensed fluid level crosses a fluid threshold crossing (not shown). In certain embodiments, where the sensor or sensors (not shown) can identify different threshold levels within vessel 210, the one or more choke manifold(s) (e.g., 135 of FIG. 4A or FIG. 4B) may be manipulated as noted above with respect to the operational, overload protection, and underload protection ranges.

In still other embodiments, such as those where the one or more mud-gas separator(s) 300 are instrumented with one or more sensors that only provide data relating to their operational state, the flow rate may be reduced by closing the one or more choke manifold(s) (e.g., 135 of FIG. 4A or FIG. 4B) in a stepwise incremental manner, or fully, when the operational state indicates that the one or more mud-gas separator(s) 300 are approaching, at, or near an overload or underload condition.

One of ordinary skill in the art will recognize that the operational, overload protection, and underload protection ranges, including how they are determined, may vary based on the type or kind of sensor(s) used in an application or design in accordance with one or more embodiments of the present invention.

Similarly, in one or more embodiments of the present invention, a critical pressure maximum (not shown) of the instrumented mud-gas separator 300 may be established by a vessel 210 specific pressure level that prevents liquids from being directed to gas vent 270. Similarly, a critical pressure minimum (not shown) may be established by a vessel 210 specific level that prevents gases from being directed to the shale shaker (140 of FIG. 4A or FIG. 4B). One of ordinary skill in the art will recognize that the critical pressure maximum (not shown) and minimum (not shown) may be physically constrained by the type or kind of instrumented mud-gas separator 300 and sensor(s) 320 used and may vary based on an application or design in accordance with one or more embodiments of the present invention.

An operational pressure maximum (not shown) may be established by an offset by a predetermined safety margin from the critical pressure maximum (not shown) that may vary based on an application or design. Similarly, an operational pressure minimum (not shown) may be established by an offset by a predetermined safety margin from critical pressure minimum (not shown) that may vary based on an application or design. One of ordinary skill in the art will recognize that the operational pressure maximum (not shown) and minimum (not shown) may vary based on the type or kind of instrumented mud-gas separator 300 and sensor(s) 320 used and variations in the performance characteristics of upstream and downstream equipment, which may impact how fast actions must be taken to prevent overloading or underloading conditions, in accordance with one or more embodiments of the present invention.

An operational pressure range (not shown) of instrumented mud-gas separator 300 may be established by the range between the operational pressure maximum (not shown) and minimum (not shown). A method and system for controlled delivery of unknown fluids may maximize the flow rate of returning fluids by opening the choke manifold(s) (e.g., 135 of FIG. 4A or FIG. 4B), and potentially changing the flow rate of the one or more mud pump(s) depending on the operation being conducted, while the pressure level is within the operational pressure range (not shown). In certain embodiments, the maximum flow rate may be established by opening the one or more choke manifold(s) (e.g., 135 of FIG. 4A or FIG. 4B) fully or in a stepwise incremental manner until they are fully opened, while the sensed pressure level (not shown) is within the operational pressure range (not shown).

An overload prevention range (not shown) of instrumented mud-gas separator 300 may be established by the range between the critical pressure maximum (not shown) and the operational pressure maximum (not shown). In certain embodiments, the flow rate may be reduced by closing the one or more choke manifold(s) (e.g., 135 of FIG. 4A or FIG. 4B) in a stepwise incremental manner when the sensed pressure level meets or exceeds the operational pressure maximum (not shown) and continues to approach the critical pressure maximum (not shown) and fully close the one or more choke manifold(s) (e.g., 135 of FIG. 4A or FIG. 4B) when the sensed pressure level meets or exceeds the critical pressure maximum (not shown).

An underload prevention range (not shown) of instrumented mud-gas separator 300 may be established by the range between the critical pressure minimum (not shown) and the operational pressure minimum (not shown). In certain embodiments, the flow rate may be reduced by closing the one or more choke manifold(s) (e.g., 135 of FIG. 4A or FIG. 4B) in a stepwise incremental manner when the sensed pressure level meets or falls below the operational pressure minimum (not shown) and continues to approach the critical pressure minimum (not shown) and fully close the one or more choke manifold(s) (e.g., 135 of FIG. 4A or FIG. 4B) when the sensed pressure level meets or falls below the critical pressure minimum (not shown).

In other embodiments, such as those where the one or more mud-gas separator(s) 300 are instrumented with one or more pressure threshold crossing sensor(s) (not shown), the flow rate may be reduced by closing the one or more choke manifold(s) (e.g., 135 of FIG. 4A or FIG. 4B) in a stepwise incremental manner, or fully, when the sensed pressure level crosses a pressure threshold crossing (not shown). In certain embodiments, where the sensor or sensors (not shown) can identify different threshold pressure levels within vessel 210, the one or more choke manifold(s) (e.g., 135 of FIG. 4A or FIG. 4B) may be manipulated as noted above with respect to the operational, overload protection, and underload protection ranges.

In still other embodiments, such as those where the one or more mud-gas separator(s) 300 are instrumented with one or more sensors that only provide data relating to their operational state, the flow rate may be reduced by closing the one or more choke manifold(s) (e.g., 135 of FIG. 4A or FIG. 4B) in a stepwise incremental manner, or fully, when the operational state indicates that the one or more mud-gas separator(s) 300 are approaching, at, or near an overload or underload condition.

One of ordinary skill in the art will recognize that the operational, overload protection, and underload protection ranges, including how they are determined, may vary based on the type or kind of sensor(s) used and may vary based on an application or design in accordance with one or more embodiments of the present invention.

One of ordinary skill in the art will also recognize that the one or more instrumented mud-gas separator(s) 300 may vary in shape, size, and configuration in accordance with one or more embodiments of the present invention. Additionally, one of ordinary skill in the art will also recognize that any instrumented mud-gas separator 300 capable of outputting a sensor signal indicative (not independently illustrated) of a state of the mud-gas separator 300 including one or more of fluid level, a pressure level, one or more threshold crossings, or operational state of the mud-gas separator 300 may be used in accordance with one or more embodiments of the present invention.

Figure 4A:
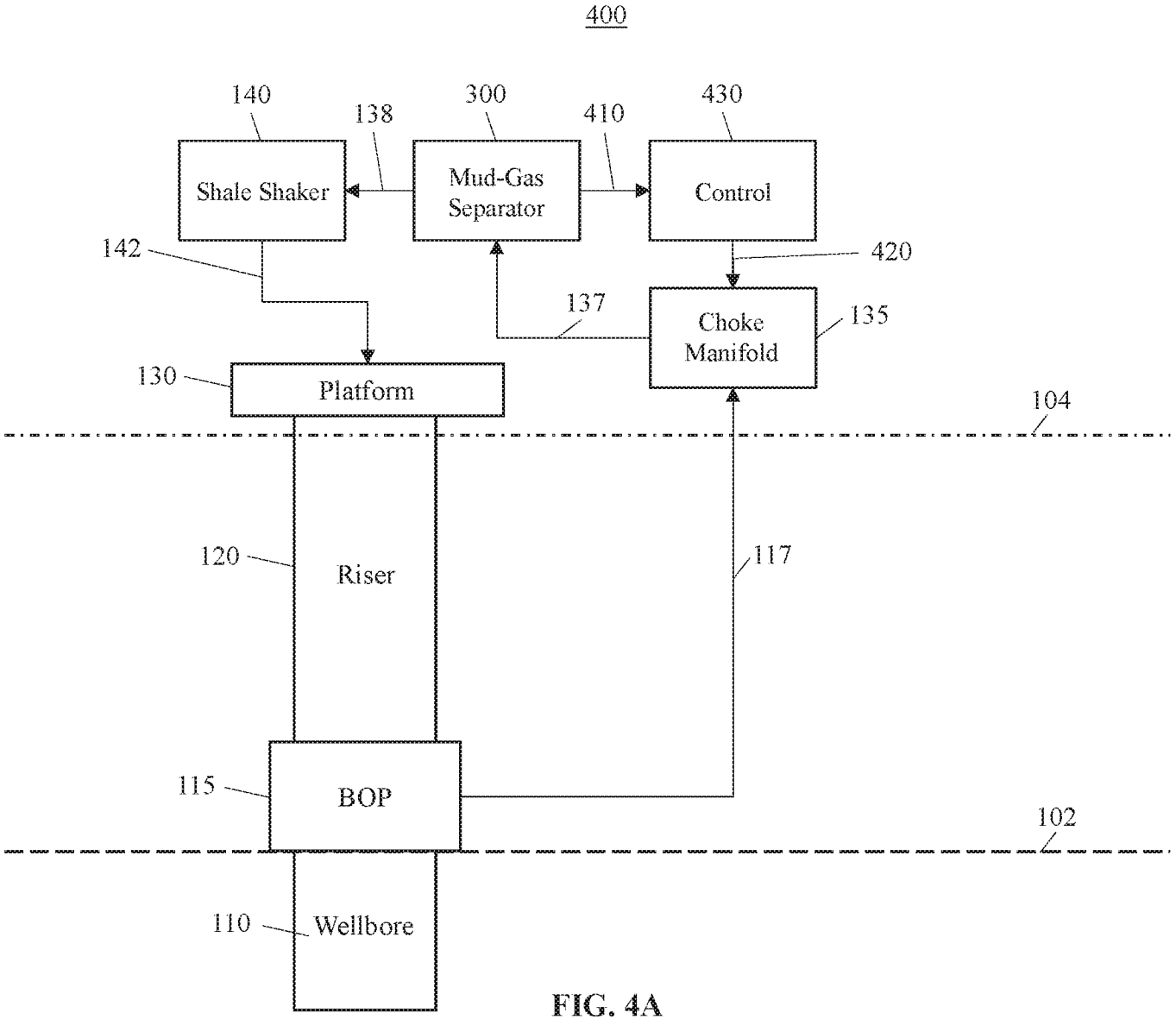
FIG. 4A shows a block diagram of a drilling system for controlled delivery of unknown fluids in accordance with one or more embodiments of the present invention.

FIG. 4A shows a block diagram of a drilling system for controlled delivery of unknown fluids 400 in accordance with one or more embodiments of the present invention. In certain embodiments, drilling system 400 may be a conventional subsea drilling system (100 of FIG. 1) that includes, at least, an instrumented mud-gas separator 300 and a control system 430 that inputs the one or more output sensor signal(s) 410 from the instrumented mud-gas separator 300, controls 420 the choke manifold 135 (typically the well control choke manifold), and optionally controls the flow rate of the one or more mud pump(s) (not shown) based, at least in part, on the input 410 to provide for controlled delivery of unknown fluids (not shown) in an intelligent, efficient, and automated manner that substantially increases safety. In other embodiments, drilling system 400 may be a land rig, a jack-up rig, or any other type of rig (not shown) that does not include a marine riser 120 (not independently illustrated), but where control system 430 controls the choke manifold 135 (typically a well control choke manifold) to control return fluid flow to a single instrumented mud-gas separator 300. One of ordinary skill in the art will recognize that the type and kind of rig may vary from drilling system to drilling system in accordance with one or more embodiments of the present invention.

During normal drilling operations, fluids (not shown) may be returned from BOP 115 to the fluids systems disposed on platform 130 via wellbore fluid return line 117 that directs fluid flow to choke manifold 135 (typically a well control choke manifold). When unknown fluids (not shown) within wellbore 110 are suspected to contain gas, control system 430 may automatically control choke manifold 135, and optionally the one or more mud pump(s) (not shown), to expedite the removal of the unknown fluids with entrained gases and process them in a safe and efficient manner. For example, when there is an unintentional influx of formation fluids suspected to contain gas, instrumented mud-gas separator 300 may be used to remove gas during, for example, well kill operations that circulate out a suspected or known kick. When a kick is suspected or detected, BOP 115 may be closed to prevent further undesired fluid flow and the one or more mud pump(s) may be stopped. The returning fluids from wellbore 110 may be directed via fluid line 137 to instrumented mud-gas separator 300 to remove entrained gas from the returning fluids. Once the gas has been removed, the degassed fluids may be directed via fluid line 138 to shale shaker 140 to remove cuttings and solids and prepare the fluids for reuse. The degassed and cleaned fluids may then be recycled for further use downhole 142.

In order to remove entrained gas in the most efficient and expeditious manner, the one or more output sensor signal(s) 410 from instrumented mud-gas separator 300 may be input into control system 430 to intelligently control choke manifold 135, and optionally the one or more mud pump(s) (not shown), to maximize the flow rate of unknown fluids to the instrumented mud-gas separator 300 while maintaining it in an operational state.

In certain embodiments, instrumented mud-gas separator 300 may include one or more fluid sensor(s) (310 of FIG. 3) that sense a fluid level, one or more threshold crossings, and/or an operational state of the mud-gas separator 300. The fluid sensor (310 of FIG. 3) may output a sensor signal 410 indicative of the state of the mud-gas separator 300 including the fluid level, the crossing of one or more threshold fluid levels, and/or the operational state of the instrumented mud-gas separator 300 to control system 430.

In other embodiments, instrumented mud-gas separator 300 may include one or more pressure sensor(s) (320 of FIG. 3) that sense a pressure level, one or more threshold crossings, or an operational state of the mud-gas separator 300. The pressure sensor (320 of FIG. 3) may output a sensor signal 410 indicative of the state of the mud-gas separator 300 including the pressure level, the crossing of one or more threshold pressure levels, and/or the operational state of the instrumented mud-gas separator 300 to control system 430.

In still other embodiments, instrumented mud-gas separator 300 may include one or more fluid sensor(s) (310 of FIG. 3) that sense a fluid level, one or more threshold crossings, or the operational state of the instrumented mud-gas separator 300 and one or more pressure sensor(s) (320 of FIG. 3) that sense a pressure level, one or more threshold crossings, or the operational state of the instrumented mud-gas separator 300. One of ordinary skill in the art will recognize that the type or kind of instrumented mud-gas separator 300, and the sensed output it provides, may vary based on an application or design in accordance with one or more embodiments of the present invention.

In one or more embodiments of the present invention, control system 430 may receive, as input, information relating to, for example, one or more of the hydrostatic pressure of the mud within wellbore 110, the hydrostatic pressure of the mud within marine riser 120, the type, kind, size, capacity, rating, and topology of shale shaker 140, instrumented mud-gas separator 300, choke manifold 135, riser 120, BOP 115, or any other equipment on the rig, the detection or expectation of an influx of unknown formation fluids suspected to contain gas, a gas expansion/flow model, and any other information that may be useful in determining the most efficient manner to remove entrained gas from returning fluids. One of ordinary skill in the art will recognize that the input information may advantageously include information that allows control system 430 to accommodate variation in the type, kind, size, capacity, rating, and topology of various equipment used that may vary from rig to rig, but may be limited to information relating to the sensor output 410 of instrumented mud-gas separator 300. As such, one of ordinary skill in the art will recognize that the input information received may vary based on an application or design in accordance with one or more embodiments of the present invention.

In one or more embodiments of the present invention, control system 430 may receive, as input, information including, but not limited to, operational range data (e.g., 350 of FIG. 3 or pressure corollary), overload protection range data (e.g., 360*a* of FIG. 3 or pressure corollary), underload protection range data (e.g., 360*b* of FIG. 3 or pressure corollary), or any other data relating to the operational state of the instrumented mud-gas separator 300 that allows control system 430 to intelligently control choke manifold 135 and optionally the one or more mud pump(s) (not shown) in view of the state of the instrumented mud-gas separator 300.

Control system 430 may regulate the state of choke manifold 135 to maximize the safe flow rate of unknown fluids to the instrumented mud-gas separator 300 in an intelligent, efficient, and automated manner based on its state. One of ordinary skill in the art will recognize that an open or closed state of choke manifold 135 is bounded by a fully opened state and a fully closed state with a number of incremental steps in between, the step size of which is typically determined by the type or kind of choke manifold 135 used. As such, control system 430 may set the state of the choke manifold 135 based on input received and the method disclosed herein. Control system 430 may receive input from instrumented mud-gas separator 300 relating to the state of the mud-gas separator 300.

In one or more embodiments of the present invention, if the fluid and/or pressure level of mud-gas separator 300 is within the operational range (e.g., 350 of FIG. 3 or pressure corollary), choke manifold 135 may be opened fully, or incrementally until fully opened, to expeditiously maximize flowrate. The degree to which choke manifold 135 may be opened may depend on the sensed level(s), the operational state of mud-gas separator 300, how close instrumented mud-gas separator 300 is to a boundary condition of the operational range, overload protection range, or underload protection range, and/or the rate of change of the sensed level(s). In one or more embodiments of the present invention, a method and system for controlled delivery of unknown fluids identifies a maximum safe flow rate for the return and processing of unknown fluids. In addition to control of choke manifold 135, in certain embodiments, control system 430 may optionally control the flow rate of one or more mud pump(s) (not shown) that provide mud downhole. One of ordinary skill in the art will recognize that, in various operations, it may be desirable to either stop, start, or change the flow rate of mud being provided downhole while controlling the delivery of unknown fluids.

In one or more embodiments of the present invention, if the sensed fluid and/or pressure levels of the instrumented mud-gas separator 300 are within the operational range (e.g., 350 of FIG. 3 or pressure corollary), indicating that the mud-gas separator 300 can handle the flow rate of the unknown fluids currently being input, control system 430 may open choke manifold 135 in a stepwise incremental manner. So long as the sensed level(s) remain within the operational range (e.g., 350 of FIG. 3 or pressure corollary), control system 430 may continue to open choke manifold 135 incrementally until it is fully opened or maintain it in the fully opened state. One of ordinary skill in the art will recognize that the stepwise incremental manner in which the choke manifold 135 may be opened may vary based on the rate of change of the sensed fluid and/or pressure levels or proximity to critical levels. If the rate of change or proximity warrants, some multiple of the stepwise incremental change may be used to increase the flow rate to the maximum in a more expeditious manner. The multiple of the incremental step size may vary based on the type, kind, size, capacity, rating, and topology of equipment used and the expected flow rates and may vary from rig to rig in accordance with one or more embodiments of the present invention.

In one or more embodiments of the present invention, if the sensed fluid and/or pressure levels cross the operational liquid maximum (e.g., 340*a* of FIG. 3 or pressure corollary) and enters the overload protection range (e.g., 360*a* of FIG. 3 or pressure corollary), control system 430 may close choke manifold 135 in a stepwise incremental manner to prevent instrumented mud-gas separator 300 from overloading. If the sensed fluid and/or pressure levels continue to increase, some multiple of the incremental step size may be used to close choke manifold 135 in a more expeditious manner. The multiple of the incremental step size may vary based on the type, kind, size, capacity, rating, and topology of equipment used and the expected flow rates and may vary from rig to rig in accordance with one or more embodiments of the present invention. If the sensed fluid and/or pressure levels meet or exceed the critical liquid level maximum (e.g., 330*a* of FIG. 3 or pressure corollary), control system 430 may fully close choke manifold 135 to prevent overload where unknown fluids may inadvertently, and dangerously, be directed to the gas vent (270 of FIG. 3).

In one or more embodiments of the present invention, if the sensed fluid and/or pressure levels cross the operational liquid minimum (e.g., 340*b* of FIG. 3 or pressure corollary) and enters the underload protection range (e.g., 360*b* of FIG. 3 or pressure corollary), control system 430 may close choke manifold 135 in a stepwise incremental manner to prevent instrumented mud-gas separator 300 from underloading. If the sensed fluid and/or pressure levels continue to decrease, some multiple of the incremental step size may be used to close choke manifold 135 in a more expeditious manner. The multiple of the incremental step size may vary based on the type, kind, size, capacity, rating, and topology of equipment used and the expected flow rates and may vary from rig to rig in accordance with one or more embodiments of the present invention. If the sensed fluid and/or pressure levels meet or fall below the critical liquid level minimum (e.g., 330*b* of FIG. 3 or pressure corollary), control system 430 may fully close choke manifold 135 to prevent underload where entrained gases may inadvertently, and dangerously, be directed to the shale shaker 140.

One of ordinary skill in the art will recognize that the actions taken by control system 430 may be dictated by the type, kind, size, capacity, rating, and topology of equipment used, their operational characteristics, and the expected flow rates and may vary from rig to rig in accordance with one or more embodiments of the present invention.

Figure 4B:
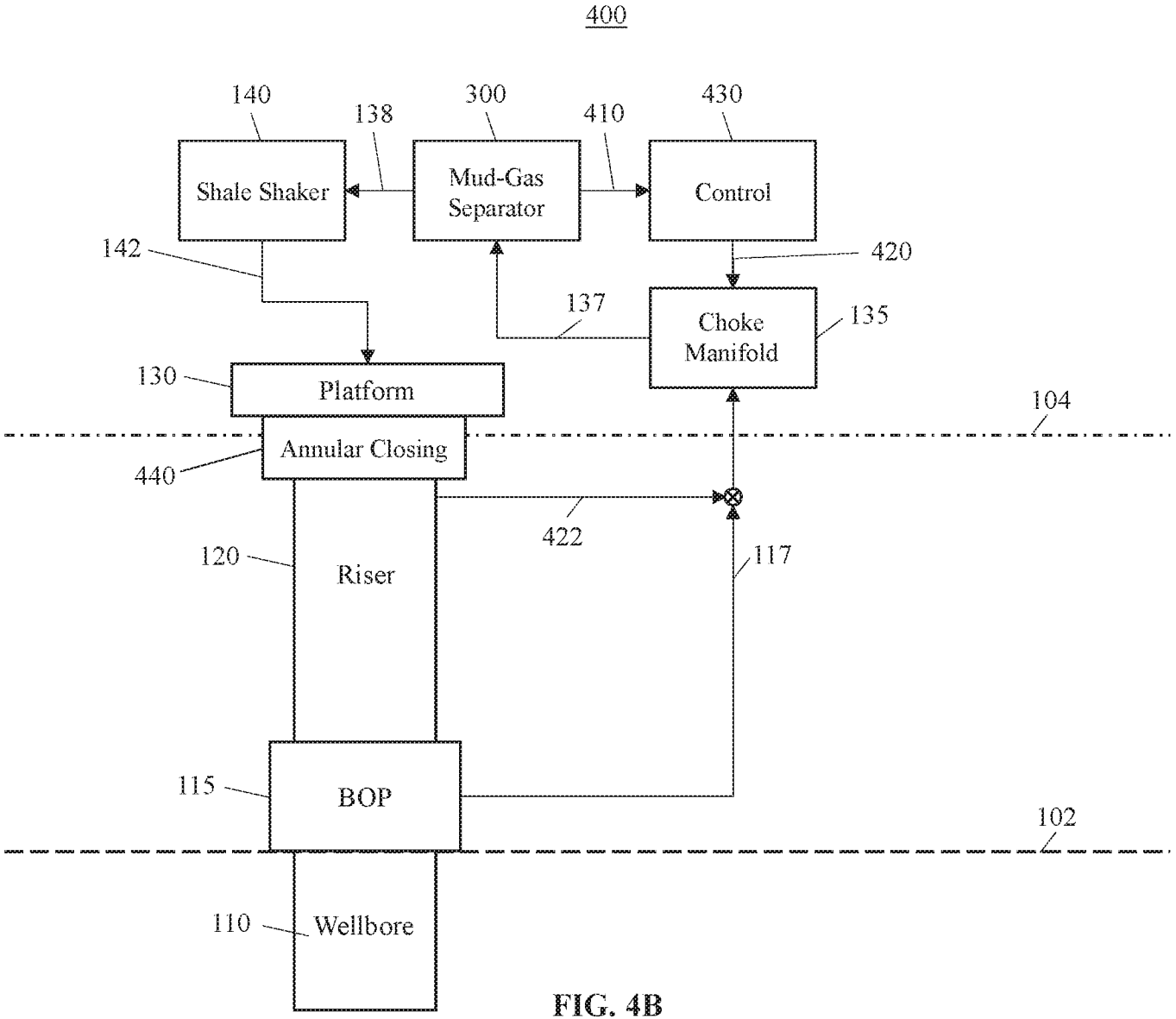
FIG. 4B shows a block diagram of a subsea drilling system for controlled delivery of unknown fluids in accordance with one or more embodiments of the present invention.

FIG. 4B shows a block diagram of a subsea drilling system for controlled delivery of unknown fluids 400 in accordance with one or more embodiments of the present invention. In certain embodiments, drilling system 400 may include, or be retrofitted with, an annular closing 440 that controllably opens and closes marine riser 120. Annular closing 440 may be a rotating control device ("RCD"), a drill string isolation tool ("DSIT"), or any other active pressure management device or system that controllably seals marine riser 120. One of ordinary skill in the art will recognize that subsea drilling system 400 may be a conventional subsea drilling system (e.g., 100 of FIG. 1) that includes, at least, an instrumented mud-gas separator 300 and a control system 430 that inputs the output sensor signal or signals 410 from the instrumented mud-gas separator 300, controls 420 choke manifold 135, and optionally controls the flow rate of the one or more mud pump(s) (not shown) based, at least in part, on the input 410 to provide for the controlled delivery of unknown fluids (not shown) in an intelligent, efficient, and automated manner that substantially increases safety.

During normal drilling operations, fluids (not shown) may be returned from BOP 115 to the fluids systems disposed on platform 130 via wellbore fluid return line 117 that directs fluid flow to choke manifold 135 (typically a well control choke manifold). Fluids may also be returned from marine riser 120 via riser return fluid line 422 that also directs fluid flow into choke manifold 135. When unknown fluids (not shown) within wellbore 110 are suspected to contain gas, control system 430 may automatically control choke manifold 135, and optionally control the flow rate of the one or more mud pump(s) (not shown) to expedite the removal of the unknown fluids with entrained gases and process them in a safe and efficient manner. For example, when there is an unintentional influx of formation fluids suspected to contain gas, instrumented mud-gas separator 300 may be used to remove gas during, for example, well kill operations that circulate out a suspected or known kick. When a kick is suspected or detected, BOP 115 may be closed to prevent further undesired fluid flow and the one or more mud pump(s) (not shown) may be stopped. The returning fluids from wellbore 110 may be directed via fluid line 137 to instrumented mud-gas separator 300 to remove entrained gas from the returning fluids. Once the gas has been removed, the degassed fluids may be directed via fluid line 138 to shale shaker 140 to remove cuttings and solids and prepare the fluids for reuse. The degassed and cleaned drilling fluids may then be recycled for further use downhole 142.

In order to remove entrained gas in the most efficient and expeditious manner, the output sensor signal(s) 410 from instrumented mud-gas separator 300 may be input into control system 430 to intelligently control choke manifold 135, and optionally the one or more mud pump(s) (not shown), to maximize the flow rate of unknown fluids to the instrumented mud-gas separator 300 while maintaining it in an operational state.

In certain embodiments, instrumented mud-gas separator 300 may include one or more fluid sensor(s) (310 of FIG. 3) that sense a fluid level, one or more threshold crossings, and/or an operational state of the mud-gas separator 300. The fluid sensor (310 of FIG. 3) may output a sensor signal 410 indicative of the state of the mud-gas separator 300 including the fluid level, the crossing of one or more threshold fluid levels, and/or the operational state of the instrumented mud-gas separator 300 to control system 430.

In other embodiments, instrumented mud-gas separator 300 may include one or more pressure sensor(s) (320 of FIG. 3) that sense a pressure level, one or more threshold crossings, or an operational state of the mud-gas separator 300. The pressure sensor (320 of FIG. 3) may output a sensor signal 410 indicative of the state of the mud-gas separator 300 including the pressure level, the crossing of one or more threshold pressure levels, and/or the operational state of the instrumented mud-gas separator 300 to control system 430.

In still other embodiments, instrumented mud-gas separator 300 may include one or more fluid sensor(s) (310 of FIG. 3) that sense a fluid level, one or more threshold crossings, or the operational state of the instrumented mud-gas separator 300 and one or more pressure sensor(s) (320 of FIG. 3) that sense a pressure level, one or more threshold crossings, or the operational state of the instrumented mud-gas separator 300. One of ordinary skill in the art will recognize that the type or kind of instrumented mud-gas separator 300, and the sensed output it provides, may vary based on an application or design in accordance with one or more embodiments of the present invention.

In one or more embodiments of the present invention, control system 430 may receive, as input, information relating to, for example, one or more of the hydrostatic pressure of the mud within wellbore 110, the hydrostatic pressure of the mud within marine riser 120, the type, kind, size, capacity, rating, and topology of shale shaker 140, instrumented mud-gas separator 300, choke manifold 135, riser 120, BOP 115, or any other equipment on the rig, the detection or expectation of an influx of unknown formation fluids suspected to contain gas, a gas expansion/flow model, and any other information that may be useful in determining the most efficient manner to remove entrained gas from returning fluids. One of ordinary skill in the art will recognize that the input information may advantageously include information that allows control system 430 to accommodate variation in the type, kind, size, capacity, rating, and topology of various equipment used that may vary from rig to rig, but may be limited to information relating to the sensor output of instrumented mud-gas separator 300. As such, one of ordinary skill in the art will recognize that the input information received may vary based on an application or design in accordance with one or more embodiments of the present invention.

In one or more embodiments of the present invention, control system 430 may receive as input information including, but not limited to, operational range data (e.g., 350 of FIG. 3 or pressure corollary), overload protection range data (e.g., 360*a* of FIG. 3 or pressure corollary), underload protection range data (e.g., 360*b* of FIG. 3 or pressure corollary), or any other data relating to the operational state of the instrumented mud-gas separator 300 that allows control system 430 to intelligently control choke manifold 135 and optionally the one or more mud pump(s) (not shown) in view of the state of the instrumented mud-gas separator 300.

Control system 430 may regulate the state of choke manifold 135 to maximize the safe flow rate of unknown fluids to the instrumented mud-gas separator 300 in an intelligent, efficient, and automated manner based on its state. One of ordinary skill in the art will recognize that an open or closed state of choke manifold 135 is bounded by a fully opened state and a fully closed state with a number of incremental steps in between, the step size of which is typically determined by the type or kind of choke manifold 135 used. As such, control system 430 may set the state of the choke manifold 135 based on input received and the method disclosed herein. Control system 430 may receive input from instrumented mud-gas separator 300 relating to the state of the mud-gas separator 300.

In one or more embodiments of the present invention, if the fluid and/or pressure level of mud-gas separator 300 is within the operational range (e.g., 350 of FIG. 3 or pressure corollary), choke manifold 135 may be opened fully, or incrementally until fully opened, to expeditiously maximize flowrate. The degree to which choke manifold 135 may be opened may depend on the sensed level(s), the operational state of mud-gas separator 300, how close instrumented mud-gas separator 300 is to a boundary condition of the operational range, overload protection range, or underload protection range, and/or the rate of change of the sensed level(s). In one or more embodiments of the present invention, a method and system for controlled delivery of unknown fluids identifies a maximum safe flow rate for the return and processing of unknown fluids. In addition to control of choke manifold 135, in certain embodiments, control system 430 may optionally control the flow rate of one or more mud pump(s) (not shown) that provide mud downhole. One of ordinary skill in the art will recognize that, in various operations, it may be desirable to either stop, start, or change the flow rate of mud being provided downhole while controlling the delivery of unknown fluids.

In one or more embodiments of the present invention, if the sensed fluid and/or pressure levels of the instrumented mud-gas separator 300 are within the operational range (e.g., 350 of FIG. 3 or pressure corollary), indicating that the mud-gas separator 300 can handle the flow rate of the unknown fluids currently being input, control system 430 may open choke manifold 135 in a stepwise incremental manner. So long as the sensed level(s) remain within the operational range (e.g., 350 of FIG. 3 or pressure corollary), control system 430 may continue to open choke manifold 135 incrementally until it is fully opened or maintain it in the fully opened state. One of ordinary skill in the art will recognize that the stepwise incremental manner in which the choke manifold 135 may be opened may vary based on the rate of change of the sensed fluid and/or pressure levels or proximity to critical levels. If the rate of change or proximity warrants, some multiple of the stepwise incremental change may be used to increase the flow rate to the maximum in a more expeditious manner. The multiple of the incremental step size may vary based on the type, kind, size, capacity, rating, and topology of equipment used and the expected flow rates and may vary from rig to rig in accordance with one or more embodiments of the present invention.

In one or more embodiments of the present invention, if the sensed fluid and/or pressure levels cross the operational liquid maximum (e.g., 340*a* of FIG. 3 or pressure corollary) and enters the overload protection range (e.g., 360*a* of FIG. 3 or pressure corollary), control system 430 may close choke manifold 135 in a stepwise incremental manner to prevent instrumented mud-gas separator 300 from overloading. If the sensed fluid and/or pressure levels continue to increase, some multiple of the incremental step size may be used to close choke manifold 135 in a more expeditious manner. The multiple of the incremental step size may vary based on the type, kind, size, capacity, rating, and topology of equipment used and the expected flow rates and may vary from rig to rig in accordance with one or more embodiments of the present invention. If the sensed fluid and/or pressure levels meet or exceed the critical liquid level maximum (e.g., 330*a* of FIG. 3 or pressure corollary), control system 430 may fully close choke manifold 135 to prevent overload where unknown fluids may inadvertently, and dangerously, be directed to the gas vent (270 of FIG. 3).

In one or more embodiments of the present invention, if the sensed fluid and/or pressure levels cross the operational liquid minimum (e.g., 340*b* of FIG. 3 or pressure corollary) and enters the underload protection range (e.g., 360*b* of FIG. 3 or pressure corollary), control system 430 may close choke manifold 135 in a stepwise incremental manner to prevent instrumented mud-gas separator 300 from underloading. If the sensed fluid and/or pressure levels continue to decrease, some multiple of the incremental step size may be used to close choke manifold 135 in a more expeditious manner. The multiple of the incremental step size may vary based on the type, kind, size, capacity, rating, and topology of equipment used and the expected flow rates and may vary from rig to rig in accordance with one or more embodiments of the present invention. If the sensed fluid and/or pressure levels meet or fall below the critical liquid level minimum (e.g., 330*b* of FIG. 3 or pressure corollary), control system 430 may fully close choke manifold 135 to prevent underload where entrained gases may inadvertently, and dangerously, be directed to the shale shaker 140.

One of ordinary skill in the art will recognize that the actions taken by control system 430 may be dictated by the type, kind, size, capacity, rating, and topology of equipment used, their operational characteristics, and the expected flow rates and may vary from rig to rig in accordance with one or more embodiments of the present invention.

Figure 5:
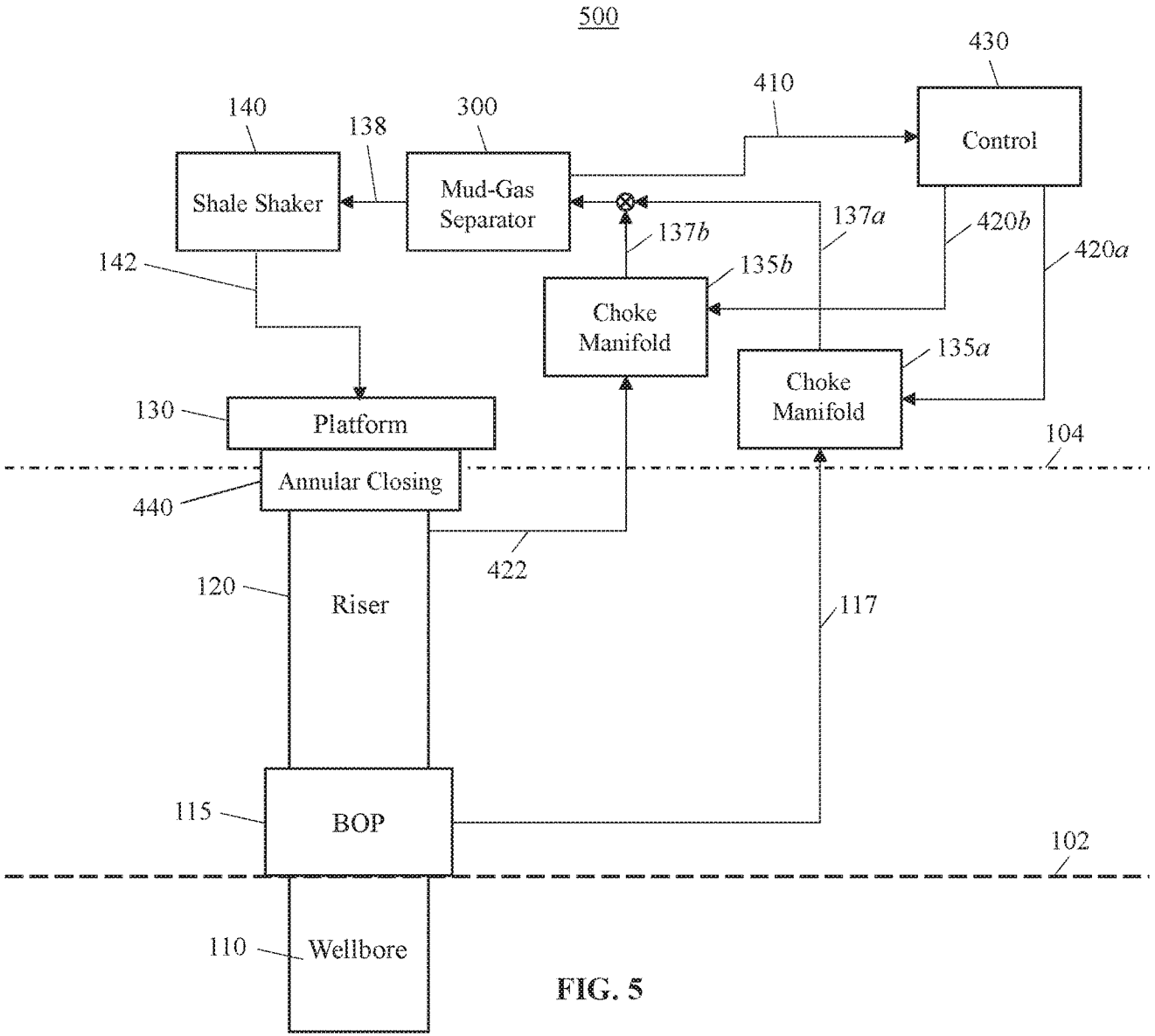
FIG. 5 shows a block diagram of a subsea drilling system for controlled delivery of unknown fluids in accordance with one or more embodiments of the present invention.

FIG. 5 shows a block diagram of a subsea drilling system for controlled delivery of unknown fluids 500 in accordance with one or more embodiments of the present invention. Subsea drilling system 500 may be an MPD system that allows for the closed-loop circulation of fluids and the management of bottomhole pressure from the surface. The control of bottomhole pressure by application of surface backpressure allows the driller to respond to downhole conditions faster than, for example, changing mud weights. MPD systems typically include an annular closing 440 that may controllably seal marine riser 120. Annular closing 440 may be a RCD, a DSIT, or any other active pressure management device or system that controllably seals marine riser 120.

MPD systems include, in addition to first choke manifold 135*a* (typically a well control choke manifold), a second choke manifold 135*b* (often, a dedicated MPD choke manifold) for managing surface backpressure. One of ordinary skill in the art will recognize that well control choke manifold 135*a* and MPD choke manifold 135*b* generally serve the same purpose, but may not be the same type or kind of manifold and may vary from one another based on an application or design in accordance with one or more embodiments of the present invention. Fluids may be returned from BOP 115 to the fluids systems disposed on platform 130 via wellbore fluid return line 117 that directs fluid flow to well control choke manifold 135*a*. Fluids may also be returned from marine riser 120 via riser fluid return line 422 that directs fluid flow to MPD choke manifold 135*b*. In certain embodiments, a single instrumented mud-gas separator 300 may be used. The fluid output of choke manifolds 135*a* and 135*b* may be directed to the instrumented mud-gas separator 300 to provide for the controlled delivery of unknown fluids (not shown) in an intelligent, efficient, and automated manner that substantially increases safety.

During normal drilling operations, fluids (not shown) may be returned from BOP 115 to the fluids systems disposed on platform 130 via wellbore fluid return line 117 that directs fluid flow to choke manifold 135*a* (typically a well control choke manifold). Fluids may also be returned from marine riser 120 via riser return fluid line 422 that also directs fluid flow into choke manifold 135*b* (often an MPD choke manifold). When unknown fluids (not shown) within wellbore 110 and/or marine riser 120 are suspected to contain gas, control system 430 may automatically control choke manifolds 135*a* and 135*b*, and optionally the one or more mud pump(s) (not shown) to expedite the removal of the unknown fluids with entrained gases and process them in a safe and efficient manner. For example, when there is an unintentional influx of formation fluids suspected to contain gas, instrumented mud-gas separator 300 may be used to remove gas during, for example, well kill operations that circulate out a suspected or known kick. When a kick is suspected or detected, BOP 115 and annular closing 440 may be closed to prevent further undesired fluid flow and the one or more mud pump(s) (not shown) may be stopped. The returning fluids from wellbore 110 may be directed via fluid line 137*a* and/or returning fluids from marine riser 120 may be directed via fluid line 137*b* to instrumented mud-gas separator 300 to remove entrained gas from the returning fluids. Once the gas has been removed, the degassed fluids may be sent via fluid line 138 to shale shaker 140 to remove cuttings and solids and prepare the fluids for reuse. The degassed and cleaned drilling fluids may then be recycled for further use downhole 142.

In order to remove entrained gas in the most efficient and expeditious manner, the output sensor signal(s) 410 from instrumented mud-gas separator 300 may be input into control system 430 to intelligently control choke manifolds 135*a* and 135*b*, and optionally the one or more mud pump(s) (not shown), to maximize the flow rate of unknown fluids to the instrumented mud-gas separator 300 while maintaining it in an operational state.

In certain embodiments, instrumented mud-gas separator 300 may include one or more fluid sensor(s) (310 of FIG. 3) that sense a fluid level, one or more threshold crossings, and/or an operational state of the mud-gas separator 300. The fluid sensor (310 of FIG. 3) may output a sensor signal 410 indicative of the state of the mud-gas separator 300 including the fluid level, the crossing of one or more threshold fluid levels, and/or the operational state of the instrumented mud-gas separator 300 to control system 430.

In other embodiments, instrumented mud-gas separator 300 may include one or more pressure sensor(s) (320 of FIG. 3) that sense a pressure level, one or more threshold crossings, or an operational state of the mud-gas separator 300. The pressure sensor (320 of FIG. 3) may output a sensor signal 410 indicative of the state of the mud-gas separator 300 including the pressure level, the crossing of one or more threshold pressure levels, and/or the operational state of the instrumented mud-gas separator 300 to control system 430.

In still other embodiments, instrumented mud-gas separator 300 may include one or more fluid sensor(s) (310 of FIG. 3) that sense a fluid level, one or more threshold crossings, or the operational state of the instrumented mud-gas separator 300 and one or more pressure sensor(s) (320 of FIG. 3) that sense a pressure level, one or more threshold crossings, or the operational state of the instrumented mud-gas separator 300. One of ordinary skill in the art will recognize that the type or kind of instrumented mud-gas separator 300, and the sensed output it provides, may vary based on an application or design in accordance with one or more embodiments of the present invention.

In one or more embodiments of the present invention, control system 430 may receive, as input, information relating to, for example, one or more of the hydrostatic pressure of the mud within wellbore 110, the hydrostatic pressure of the mud within marine riser 120, the type, kind, size, capacity, rating, and topology of shale shaker 140, instrumented mud-gas separator 300, choke manifold 135*a*, choke manifold 135*b*, riser 120, BOP 115, or any other equipment on the rig, the detection or expectation of an influx of unknown formation fluids suspected to contain gas, a gas expansion/flow model, and any other information that may be useful in determining the most efficient manner to remove entrained gas from returning fluids. One of ordinary skill in the art will recognize that the input information may advantageously include information that allows control system 430 to accommodate variation in the type, kind, size, capacity, rating, and topology of various equipment used that may vary from rig to rig, but may be limited to information relating to the sensor output of instrumented mud-gas separator 300. As such, one of ordinary skill in the art will recognize that the input information received may vary based on an application or design in accordance with one or more embodiments of the present invention.

In one or more embodiments of the present invention, control system 430 may receive, as input, information including, but not limited to, operational range data (e.g., 350 of FIG. 3 or pressure corollary), overload protection range data (e.g., 360*a* of FIG. 3 or pressure corollary), underload protection range data (e.g., 360*b* of FIG. 3 or pressure corollary), or any other data relating to the operational state of the instrumented mud-gas separator 300 that allows control system 430 to intelligently control choke manifold 135 and optionally the one or more mud pump(s) (not shown) in view of the state of the instrumented mud-gas separator 300.

Control system 430 may regulate the state of choke manifolds 135*a* and 135*b* to maximize the safe flow rate of unknown fluids to the instrumented mud-gas separator 300 in an intelligent, efficient, and automated manner based on its state. One of ordinary skill in the art will recognize that an open or closed state of each of choke manifold 135*a* and 135*b* is bounded by a fully opened state and a fully closed state with a number of incremental steps in between, the step size of which is typically determined by the type or kind of choke manifold used. As such, control system 430 may set the state of the choke manifolds 135*a* and 135*b* based on input received and the method disclosed herein. Control system 430 may receive input from instrumented mud-gas separator 300 relating to the state of the mud-gas separator 300.

In one or more embodiments of the present invention, if the sensed fluid and/or pressure levels of the instrumented mud-gas separator 300 are within the operational range (e.g., 350 of FIG. 3 or pressure corollary), choke manifolds 135*a* and/or 135*b* may be opened to some degree. The degree to which choke manifolds 135*a* and/or 135*b* may be opened may depend on the sensed level(s), the operational state of mud-gas separator 300, how close instrumented mud-gas separator 300 is to a boundary condition of the operational range, overload protection range, or underload protection range, and/or the rate of change of the sensed level(s). In one or more embodiments of the present invention, a method and system for controlled delivery of unknown fluids identifies a maximum safe flow rate for the return and processing of unknown fluids. In addition to control of choke manifolds 135*a* and/or 135*b*, in certain embodiments, control system 430 may optionally control the flow rate of one or more mud pump(s) (not shown) that provide mud downhole. One of ordinary skill in the art will recognize that, in various operations, it may be desirable to either stop, start, or change the flow rate of mud being provided downhole while controlling the delivery of unknown fluids.

In one or more embodiments of the present invention, if the sensed fluid and/or pressure levels of the instrumented mud-gas separator 300 are within the operational range (e.g., 350 of FIG. 3 or pressure corollary), indicating that the mud-gas separator 300 can handle the flow rate of the unknown fluids currently being input, control system 430 may open choke manifolds 135*a* and 135*b* in a stepwise incremental manner. So long as the sensed level(s) remain within the operational range (e.g., 350 of FIG. 3 or pressure corollary), control system 430 may continue to open choke manifolds 135*a* and 135*b* incrementally until fully opened or maintain the fully opened state. One of ordinary skill in the art will recognize that the stepwise incremental manner in which choke manifolds 135*a* and 135*b* may be opened may vary based on the rate of change of the sensed fluid and/or pressure levels or proximity to critical levels. If the rate of change or proximity warrants, some multiple of the stepwise incremental change may be used to increase the flow rate to the maximum in a more expeditious manner. The multiple of the incremental step size may vary based on the type, kind, size, capacity, rating, and topology of equipment used and the expected flow rates and may vary from rig to rig in accordance with one or more embodiments of the present invention.

In one or more embodiments of the present invention, if the sensed fluid and/or pressure levels cross the operational liquid maximum (e.g., 340*a* of FIG. 3 or pressure corollary) and enters the overload protection range (e.g., 360*a* of FIG. 3 or pressure corollary), control system 430 may close choke manifolds 135*a* and 135*b* in a stepwise incremental manner to prevent instrumented mud-gas separator 300 from overloading. If the sensed fluid and/or pressure levels continue to increase, some multiple of the incremental step size may be used to close choke manifolds 135*a* and 135*b* in a more expeditious manner. The multiple of the incremental step size may vary based on the type, kind, size, capacity, rating, and topology of equipment used and the expected flow rates and may vary from rig to rig in accordance with one or more embodiments of the present invention. If the sensed fluid and/or pressure levels meet or exceed the critical liquid level maximum (e.g., 330*a* of FIG. 3 or pressure corollary), control system 430 may fully close choke manifolds 135*a* and 135*b* to prevent overload where unknown fluids may inadvertently, and dangerously, be directed to the gas vent (270 of FIG. 3).

In one or more embodiments of the present invention, if the sensed fluid and/or pressure levels cross the operational liquid minimum (e.g., 340*b* of FIG. 3 or pressure corollary) and enters the underload protection range (e.g., 360*b* of FIG. 3 or pressure corollary), control system 430 may close choke manifolds 135*a* and 135*b* in a stepwise incremental manner to prevent instrumented mud-gas separator 300 from underloading. If the sensed fluid and/or pressure levels continue to decrease, some multiple of the incremental step size may be used to close choke manifolds 135*a* and 135*b* in a more expeditious manner. The multiple of the incremental step size may vary based on the type, kind, size, capacity, rating, and topology of equipment used and the expected flow rates and may vary from rig to rig in accordance with one or more embodiments of the present invention. If the sensed fluid and/or pressure levels meet or fall below the critical liquid level minimum (e.g., 330*b* of FIG. 3 or pressure corollary), control system 430 may fully close choke manifolds 135*a* and 135*b* to prevent underload where entrained gases may inadvertently, and dangerously, be directed to the shale shaker 140.

If control system 430 receives input indicating where unknown fluids suspected to contain gas are located, such as, wellbore 110, marine riser 120, or both, control system 430 may independently or collaboratively control choke manifolds 135*a* and 135*b*. For example, if unknown fluids suspected to contain gas are believed to be in wellbore 110, but not marine riser 120, control system 430 may reduce or stop flow from choke manifold 135*b* to maximize the flow rate out of choke manifold 135*a*. Similarly, if unknown fluids suspected to contain gas are believed to be in marine riser 120, but not wellbore 110, control system 430 may reduce or stop flow from choke manifold 135*a* to maximize the flow rate out of choke manifold 135*b*. If unknown fluids suspected to contain gas are believed to be present in both wellbore 110 and marine riser 120, control system 430 may control choke manifolds 135*a* and 135*b* in a similar manner, potentially adjusted for differing amounts of return fluids believed to be present and/or differences in the type or kind of the choke manifold, to ensure that both wellbore 110 and marine riser 120 are circulated out accordingly. However, based on input, control system 430 may favor one or the other of choke manifolds 135*a* and 135*b*, by, for example, using a larger or multiple of the step size when making a change. Such an approach may be useful when the expected amount of unknown fluids are substantially larger in either wellbore 110 or marine riser 120, thereby allowing control system 430 to safely and efficiently remove the unknown fluids suspected to contain gas.

One of ordinary skill in the art will recognize that the actions taken by control system 430 may be dictated by the type, kind, size, capacity, rating, and topology of equipment used, their operational characteristics, and the expected flow rates and may vary from rig to rig in accordance with one or more embodiments of the present invention.

Figure 6:
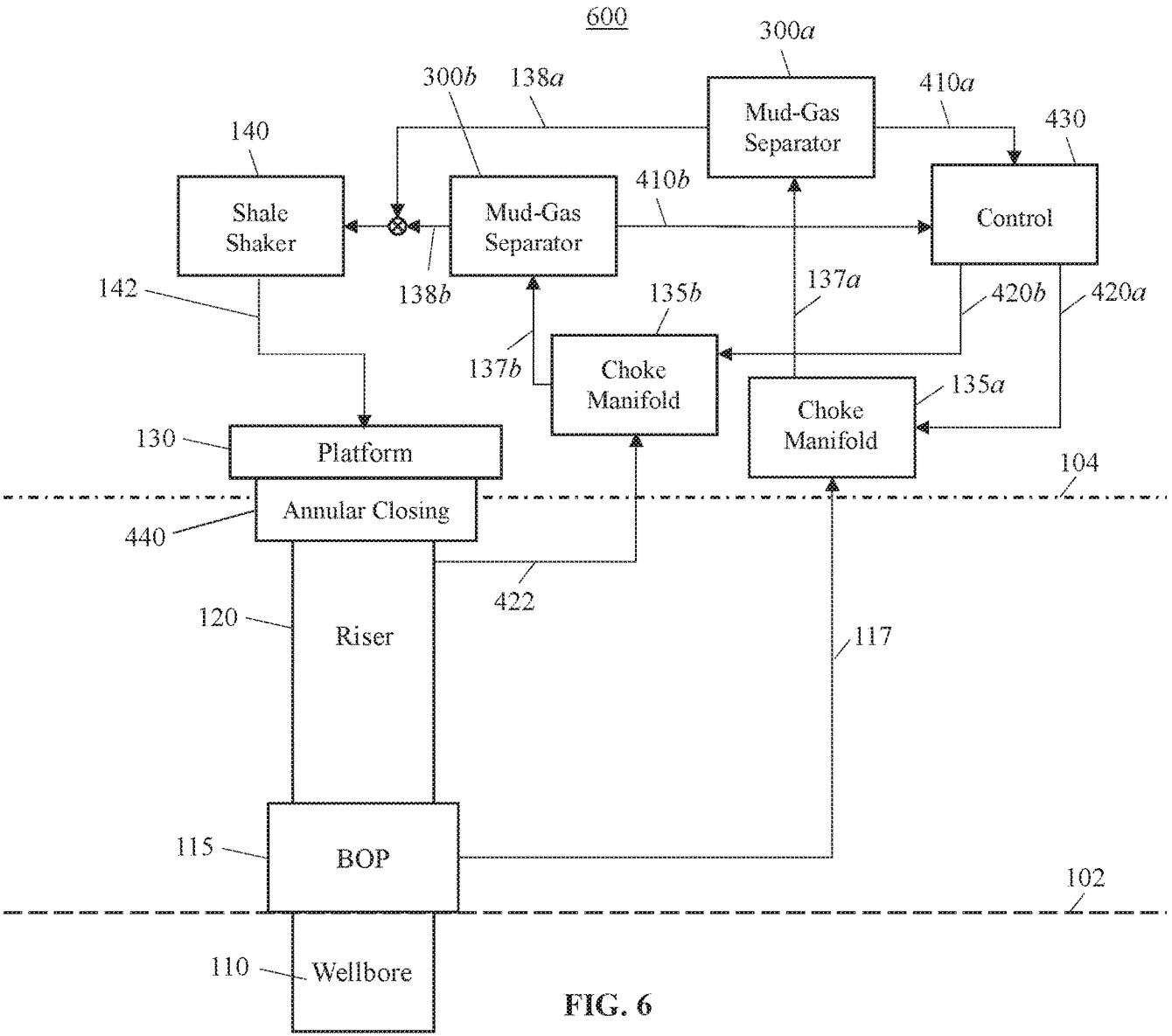
FIG. 6 shows a block diagram of a subsea drilling system for controlled delivery of unknown fluids in accordance with one or more embodiments of the present invention.

FIG. 6 show a block diagram of a subsea drilling system for controlled delivery of unknown fluids 600 in accordance with one or more embodiments of the present invention. Subsea drilling system 600 may be an MPD system that allows for the closed-loop circulation of fluids and the management of bottomhole pressure from the surface. The control of bottomhole pressure by application of surface backpressure allows the driller to respond to downhole conditions faster than, for example, changing mud weights. MPD systems typically include an annular closing 440 that may controllably seal the marine riser 120. Annular closing 440 may be a RCD, a DSIT, or any other active pressure management device or system that controllably seals marine riser 120.

MPD systems include, in addition to well control choke manifold 135*a*, a dedicated MPD choke manifold 135*b* for managing surface backpressure. One of ordinary skill in the art will recognize that well control choke manifold 135*a* and MPD choke manifold 135*b* generally serve the same purpose, but may not be the same type or kind of manifold and may vary from one another based on an application or design in accordance with one or more embodiments of the present invention. Fluids may be returned from BOP 115 to the fluids systems disposed on platform 130 via wellbore fluid return line 117 that feeds into well control choke manifold 135*a* that directs the flow of fluids to a first instrumented mud-gas separator 300*a*. Fluids may also be returned from marine riser 120 via riser fluid return line 422 that feeds into MPD choke manifold 135*b* that directs the flow of fluids to a second instrumented mud-gas separator 300*b*. The fluid output of choke manifolds 135*a* and 135*b* may be directed to the instrumented mud-gas separators 300*a* and 300*b* to provide for the controlled delivery of unknown fluids (not shown) in an intelligent, efficient, and automated manner that substantially increases safety.

During normal drilling operations, fluids (not shown) may be returned from BOP 115 to the fluids systems disposed on platform 130 via wellbore fluid return line 117 that directs fluid flow to choke manifold 135*a* (typically a well control choke manifold) and instrumented mud-gas separator 300*a*. Fluids may also be returned from marine riser 120 via riser return fluid line 422 that directs fluid flow into choke manifold 135*b* (often an MPD choke manifold) and instrumented mud-gas separator 300*b*. When unknown fluids (not shown) within wellbore 110 and/or marine riser 120 are suspected to contain gas, control system 430 may automatically control choke manifolds 135*a* and 135*b*, and optionally the one or more mud pump(s) (not shown) to expedite the removal of the unknown fluids with entrained gases and process them in a safe and efficient manner. For example, when there is an unintentional influx of formation fluids suspected to contain gas, instrumented mud-gas separators 300*a* and 300*b* may be used to remove gas during, for example, well kill operations that circulate out a suspected or known kick. When a kick is suspected or detected, BOP 115 and annular closing 440 may be closed to prevent further undesired fluid flow and the one or more mud pump(s) (not shown) may be stopped. The returning fluids from wellbore 110 may be directed via fluid line 137*a* to instrumented mud-gas separator 300*a* and/or returning fluids from marine riser 120 may be directed via fluid line 137*b* to instrumented mud-gas separator 300*b* to remove entrained gas from the returning fluids. Once the gas has been removed, the degassed fluids may be sent via fluid line 138*a* and 138*b* to shale shaker 140 to remove cuttings and solids and prepare the fluids for reuse. The degassed and cleaned drilling fluids may then be recycled for further use downhole 142.

In order to remove entrained gas in the most efficient and expeditious manner, the output sensor signal(s) 410 from instrumented mud-gas separators 300*a* and 300*b* may be input into control system 430 to intelligently control choke manifolds 135*a* and 135*b*, and optionally the one or more mud pump(s) (not shown), to maximize the flow rate of unknown fluids to the instrumented mud-gas separators 300*a* and 300*b* while maintaining it in an operational state.

In certain embodiments, one or both of instrumented mud-gas separators 300*a* and 300*b* may include one or more fluid sensor(s) (310 of FIG. 3) that sense a fluid level, one or more threshold crossings, and/or an operational state of instrumented mud-gas separators 300*a* and 300*b*. The fluid sensor (310 of FIG. 3) may output a sensor signal 410 indicative of the state of the mud-gas separators 300*a* and 300*b* including the fluid level, the crossing of one or more threshold fluid levels, and/or the operational state of instrumented mud-gas separators 300*a* and 300*b* to control system 430.

In other embodiments, one or both of instrumented mud-gas separators 300*a* and 300*b* may include one or more pressure sensor(s) (320 of FIG. 3) that sense a pressure level, one or more threshold crossings, or an operational state of instrumented mud-gas separators 300*a* and 300*b*. The pressure sensor (320 of FIG. 3) may output a sensor signal 410 indicative of the state of the mud-gas separators 300*a* and 300*b* including the pressure level, the crossing of one or more threshold pressure levels, and/or the operational state of instrumented mud-gas separators 300*a* and 300*b* to control system 430.

In still other embodiments, instrumented mud-gas separators 300*a* and 300*b* may include one or more fluid sensor(s) (310 of FIG. 3) that sense a fluid level, one or more threshold crossings, or the operational state of instrumented mud-gas separators 300*a* and 300*b* and one or more pressure sensor(s) (320 of FIG. 3) that sense a pressure level, one or more threshold crossings, or the operational state of instrumented mud-gas separators 300*a* and 300*b*. One of ordinary skill in the art will recognize that the type or kind of instrumented mud-gas separators 300*a* and 300*b*, and the sensed output they provides, may vary based on an application or design in accordance with one or more embodiments of the present invention.

In one or more embodiments of the present invention, control system 430 may receive as input information relating to, for example, one or more of the hydrostatic pressure of the mud within wellbore 110, the hydrostatic pressure of the mud within marine riser 120, the type, kind, size, capacity, rating, and topology of shale shaker 140, instrumented mud-gas separator 300*a*, instrumented mud-gas separator 300*b*, choke manifold 135*a*, choke manifold 135*b*, riser 120, BOP 115, or any other equipment on the rig, the detection or expectation of an influx of unknown formation fluids suspected to contain gas, a gas expansion/flow model, and any other information that may be useful in determining the most efficient manner to remove entrained gas from returning fluids. One of ordinary skill in the art will recognize that the input information may advantageously include information that allows control system 430 to accommodate variation in the type, kind, size, capacity, rating, and topology of various equipment used that may vary from rig to rig, but may be limited to information relating to the sensor output of instrumented mud-gas separator 300*a* and instrumented mud-gas separator 300*b*. As such, one of ordinary skill in the art will recognize that the input information received may vary based on an application or design in accordance with one or more embodiments of the present invention.

In one or more embodiments of the present invention, control system 430 may receive as input information including, but not limited to, operational range data (e.g., 350 of FIG. 3 or pressure corollary), overload protection range data (e.g., 360*a* of FIG. 3 or pressure corollary), underload protection range data (e.g., 360*b* of FIG. 3 or pressure corollary), or any other data relating to the operational state of each of the instrumented mud-gas separators 300*a* and 300*b* that allows control system 430 to intelligently control choke manifolds 135*a* and 135*b* and optionally the one or more mud pump(s) (not shown) in view of the state of the instrumented mud-gas separators 300*a* and 300*b*.

Control system 430 may regulate the state of choke manifolds 135*a* and 135*b* to maximize the safe flow rate of unknown fluids to the instrumented mud-gas separators 300*a* and 300*b* in an intelligent, efficient, and automated manner based on their state. One of ordinary skill in the art will recognize that an open or closed state of each of choke manifold 135*a* and 135*b* is bounded by a fully opened state and a fully closed state with a number of incremental steps in between, the step size of which is typically determined by the type or kind of choke manifold used. As such, control system 430 may set the state of the choke manifolds 135*a* and 135*b* based on input received and the method disclosed herein. Control system 430 may receive input from instrumented mud-gas separators 300*a* and 300*b* relating to the state of the instrumented mud-gas separators 300*a* and 300*b*.

In one or more embodiments of the present invention, if the sensed fluid and/or pressure levels of a given instrumented mud-gas separator 300*a* and/or 300*b* are within the operational range (e.g., 350 of FIG. 3 or pressure corollary), choke manifolds 135*a* and/or 135*b* may be opened to some degree. The degree to which choke manifolds 135*a* and/or 135*b* may be opened may depend on the sensed level(s), the operational state of instrumented mud-gas separators 300*a* and 300*b*, how close instrumented mud-gas separators 300*a* and 300*b* is to a boundary condition of the operational range, overload protection range, or underload protection range, and/or the rate of change of the sensed level(s). In one or more embodiments of the present invention, a method and system for controlled delivery of unknown fluids identifies a maximum safe flow rate for the return and processing of unknown fluids. In addition to control of choke manifolds 135*a* and/or 135*b*, in certain embodiments, control system 430 may optionally control the flow rate of one or more mud pump(s) (not shown) that provide mud downhole. One of ordinary skill in the art will recognize that, in various operations, it may be desirable to either stop, start, or change the flow rate of mud being provided downhole while controlling the delivery of unknown fluids.

In one or more embodiments of the present invention, if the sensed fluid and/or pressure levels of instrumented mud-gas separator 300*a* and/or instrumented mud-gas separator 300*b* are within the operational range (e.g., 350 of FIG. 3 or pressure corollary), indicating that the respective mud-gas separator 300*a* and/or 300*b* can handle the flow rate of the unknown fluids currently being input, control system 430 may open the respective choke manifold 135*a* and/or 135*b* in a stepwise incremental manner. So long as the sensed level(s) remain within the operational range (e.g., 350 of FIG. 3 or pressure corollary), control system 430 may continue to open the respective choke manifold 135*a* and/or 135*b* incrementally until fully opened or maintain the fully opened state. One of ordinary skill in the art will recognize that the stepwise incremental manner in which choke manifolds 135*a* and/or 135*b* may be opened may vary based on the rate of change of the sensed fluid and/or pressure levels or proximity to critical levels. If the rate of change or proximity warrants, some multiple of the stepwise incremental change may be used to increase the flow rate to the maximum in a more expeditious manner. The multiple of the incremental step size may vary based on the type, kind, size, capacity, rating, and topology of equipment used and the expected flow rates and may vary from rig to rig in accordance with one or more embodiments of the present invention.

In one or more embodiments of the present invention, if the sensed fluid and/or pressure levels of a given instrumented mud-gas separator 300*a* and/or 300*b* cross the operational liquid maximum (e.g., 340*a* of FIG. 3 or pressure corollary) and enters the overload protection range (e.g., 360*a* of FIG. 3 or pressure corollary), control system 430 may close the respective choke manifold 135*a* and/or 135*b* in a stepwise incremental manner to prevent the respective instrumented mud-gas separator 300*a* and/or 300*b* from overloading. If the sensed fluid and/or pressure levels continue to increase, some multiple of the incremental step size may be used to close choke manifolds 135*a* and/or 135*b* in a more expeditious manner. The multiple of the incremental step size may vary based on the type, kind, size, capacity, rating, and topology of equipment used and the expected flow rates and may vary from rig to rig in accordance with one or more embodiments of the present invention. If the sensed fluid and/or pressure levels meet or exceed the critical liquid level maximum (e.g., 330*a* of FIG. 3 or pressure corollary), control system 430 may fully close choke manifolds 135*a* and 135*b* to prevent overload where unknown fluids may inadvertently, and dangerously, be directed to the gas vent (270 of FIG. 3).

In one or more embodiments of the present invention, if the sensed fluid and/or pressure levels of a given instrumented mud-gas separator 300*a* and/or 300*b* cross the operational liquid minimum (e.g., 340*b* of FIG. 3 or pressure corollary) and enters the underload protection range (e.g., 360*b* of FIG. 3 or pressure corollary), control system 430 may close the respective choke manifold 135*a* and/or 135*b* in a stepwise incremental manner to prevent the respective instrumented mud-gas separator 300*a* and/or 300*b* from underloading. If the sensed fluid and/or pressure levels continue to decrease, some multiple of the incremental step size may be used to close choke manifolds 135*a* and/or 135*b* in a more expeditious manner. The multiple of the incremental step size may vary based on the type, kind, size, capacity, rating, and topology of equipment used and the expected flow rates and may vary from rig to rig in accordance with one or more embodiments of the present invention. If the sensed fluid and/or pressure levels meet or fall below the critical liquid level minimum (e.g., 330*b* of FIG. 3 or pressure corollary), control system 430 may fully close choke manifolds 135*a* and 135*b* to prevent underload where entrained gases may inadvertently, and dangerously, be directed to the shale shaker 140.

One of ordinary skill in the art will recognize that, because each choke manifold 135*a* and 135*b* have dedicated mud-gas separators 300*a* and 300*b* respectively, control system 430 may maximize the flow rate for each of choke manifold 135*a* and 135*b* independent of one another, based on the state of their respective mud-gas separators 300*a* and 300*b*. However, if the mud-gas separators 300*a* and 300*b* feed into the same, for example, shale shaker 140, downstream considerations may be taken into consideration and choke manifolds 135*a* and 135*b* may be adjusted in a collaborative manner to maximize the removal of entrained gases without overburdening the fluids processing systems.

One of ordinary skill in the art will recognize that the actions taken by control system 430 may be dictated by the type, kind, size, capacity, rating, and topology of equipment used, their operational characteristics, and the expected flow rates and may vary from rig to rig in accordance with one or more embodiments of the present invention.

Figure 7:
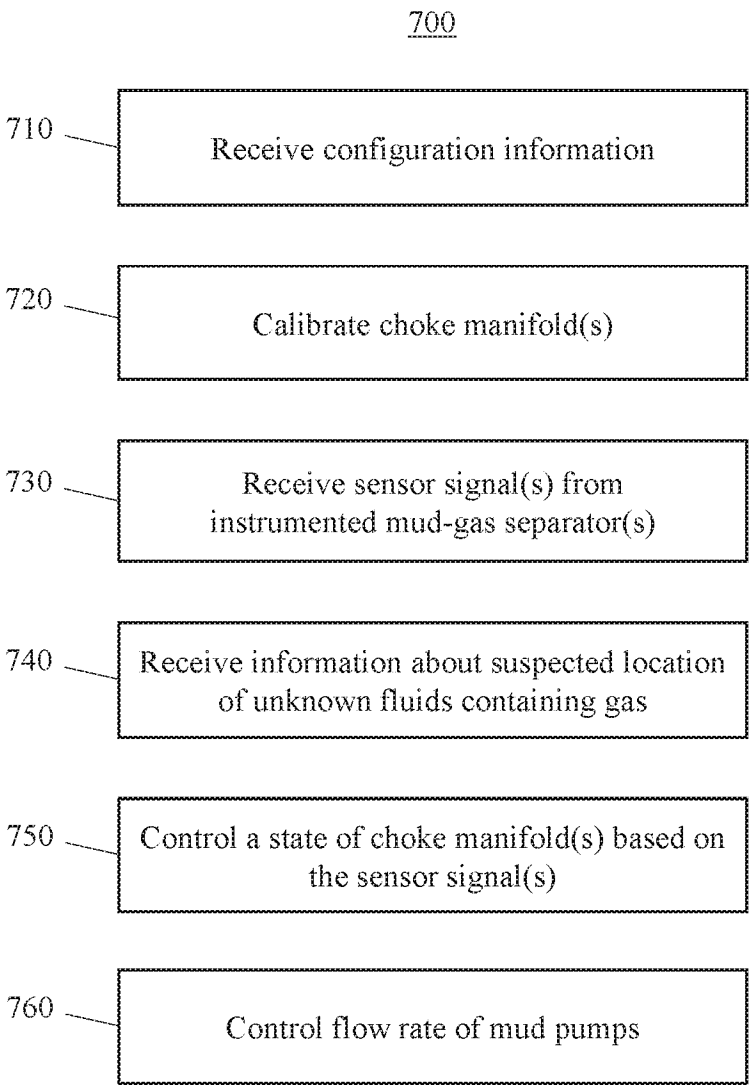
FIG. 7 shows a method of controlled delivery of unknown fluids in accordance with one or more embodiments of the present invention.

FIG. 7 shows a method 700 of controlled delivery of unknown fluids in accordance with one or more embodiments of the present invention.

In certain embodiments, such as those that include one choke manifold and one instrumented mud-gas separator or those that include two choke manifolds and two instrumented mud-gas separators, in step 710, a control system may receive configuration information about a drilling system. The configuration information may include, for example, the type, kind, rating, and operational specifications of equipment that may be on the rig. For example, the information may include the type, kind, rating, and operational specifications of choke manifold(s) and the instrumented mud-gas separator(s) that allow the control system to manipulate the choke manifold(s). In step 720, the choke manifold(s) may be calibrated so that the control system may control the open or closed state of the choke manifold(s) in a precise manner. For example, each choke manifold may have a fully opened state, a fully closed state, and a number of intermediate states that may be analog or digital, and calibration allows the control system to change the state of the choke manifold(s) in a stepwise, or programmable, manner with predictable results at the respective choke. In step 730, the control system may receive sensor signal(s) from the instrumented mud-gas separator(s) indicative of the state of the instrumented mud-gas separator(s). The sensor signal(s) may comprise an indication of one or more of a fluid level, a crossing of one or more threshold fluid levels, a pressure level, a crossing of one or more threshold pressure levels, and an operational state of the instrumented mud-gas separator(s). In step 740, the control system may receive input information relating to the suspected location of unknown fluids believed to contain gas.

In step 750, the control system may control a state of the choke manifold(s) based on the sensor signal(s). If the sensed fluid and/or pressure levels of the instrumented mud-gas separator(s) are within an operational range, the control system may open the respective choke manifold(s) in a stepwise incremental manner. So long as the sensed level(s) remain within the operational range, the control system may continue to open the respective choke manifold(s) until fully opened or maintain the fully opened state.

If the sensed fluid and/or pressure levels of the instrumented mud-gas separator(s) cross the operational liquid maximum and enter the overload protection range, the control system may close the respective choke manifold(s) in a stepwise incremental manner to prevent the respective instrumented mud-gas separator(s) from overloading. If the sensed fluid and/or pressure levels continue to increase, some multiple of the incremental step size may be used to close the respective choke manifold(s) in a more expeditious manner. If the sensed fluid and/or pressure levels meet or exceed the critical liquid level maximum, the control system may fully close the respective choke manifold(s) to prevent overload where unknown fluids may inadvertently, and dangerously, be directed to the gas vent.

If the sensed fluid and/or pressure levels of the instrumented mud-gas separator(s) cross the operational liquid minimum and enter the underload protection range, the control system may close the respective choke manifold(s) in a stepwise incremental manner to prevent the respective instrumented mud-gas separator(s) from underloading. If the sensed fluid and/or pressure levels continue to decrease, some multiple of the incremental step size may be used to close the respective choke manifold(s) in a more expeditious manner. If the sensed fluid and/or pressure levels meet or fall below the critical liquid level minimum, the control system may fully close the respective choke manifold(s) to prevent underload where unknown fluids containing gas may be directed to the shale shaker.

In step 760, the control system may optionally either stop, start, or change the flow rate out of the one or more mud pump(s) based on the type of operation being conducted and the state of the choke manifold(s) based on the sensor signal(s).

In other embodiments, such as those that include two choke manifolds and one instrumented mud-gas separator, in step 710, a control system may receive configuration information about a drilling system. The configuration information may include, for example, the type, kind, rating, and operational specifications of equipment that may be on the rig. For example, the information may include the type, kind, rating, and operational specifications of choke manifold(s) and the instrumented mud-gas separator that allow the control system to manipulate the choke manifold(s). In step 720, the choke manifold(s) may be calibrated so that the control system may control the open or closed state of the choke manifold(s) in a precise manner. For example, each choke manifold may have a fully opened state, a fully closed state, and a number of intermediate states that may be analog or digital, and calibration allows the control system to change the state of the choke manifold(s) in a stepwise, or programmable, manner with predictable results at the respective choke. In step 730, the control system may receive sensor signal(s) from the instrumented mud-gas separator indicative of the state of the instrumented mud-gas separator. The sensor signal(s) may comprise an indication of one or more of a fluid level, a crossing of one or more threshold fluid levels, a pressure level, a crossing of one or more threshold pressure levels, and an operational state of the instrumented mud-gas separator. In step 740, the control system may receive input information relating to the suspected location of unknown fluids believed to contain gas.

In step 750, the control system may control a state of the choke manifold(s) based on the sensor signal(s). If the sensed fluid and/or pressure levels of the instrumented mud-gas separator are within an operational range, the control system may open the respective choke manifold(s) in a stepwise incremental manner. So long as the sensed level(s) remain within the operational range, the control system may continue to open the respective choke manifold(s) until fully opened or maintain the fully opened state.

If the sensed fluid and/or pressure levels of the instrumented mud-gas separator cross the operational liquid maximum and enter the overload protection range, the control system may close the respective choke manifold(s) in a stepwise incremental manner to prevent the respective instrumented mud-gas separator from overloading. If the sensed fluid and/or pressure levels continue to increase, some multiple of the incremental step size may be used to close the respective choke manifold(s) in a more expeditious manner. If the sensed fluid and/or pressure levels meet or exceed the critical liquid level maximum, the control system may fully close the respective choke manifold(s) to prevent overload where unknown fluids may inadvertently, and dangerously, be directed to the gas vent.

If the sensed fluid and/or pressure levels of the instrumented mud-gas separator cross the operational liquid minimum and enter the underload protection range, the control system may close the respective choke manifold(s) in a stepwise incremental manner to prevent the respective instrumented mud-gas separator(s) from underloading. If the sensed fluid and/or pressure levels continue to decrease, some multiple of the incremental step size may be used to close the respective choke manifold(s) in a more expeditious manner. If the sensed fluid and/or pressure levels meet or fall below the critical liquid level minimum, the control system may fully close the respective choke manifold(s) to prevent underload where unknown fluids containing gas may be directed to the shale shaker.

If the control system receives input information indicating that unknown fluids believed to contain gas are in the marine riser and not the wellbore, the control system may stop the one or more mud pump(s) injecting into the wellbore and close the choke manifold for the wellbore to maximize flow rate out of the choke manifold for the marine riser. Similarly, if the control system receives input information indicating that unknown fluids believed to contain gas are in the wellbore and not the marine riser, the control system may close the choke manifold for the marine riser to maximize flow rate out of the choke manifold for the wellbore. If the control system receives input information indicating unknown fluids believed to contain gas are located in both the wellbore and the marine riser, but one is believed to contain more fluid and gas, the control system may give priority to that respective choke manifold. Priority may be some multiple of the step size setting for that choke manifold or other means to prioritize its flow over that of the other choke manifold.

In step 760, the control system may optionally either stop, start, or change the flow rate out of the one or more mud pump(s) based on the type of operation being conducted and the state of the choke manifold(s) based on the sensor signal(s).

Figure 8:
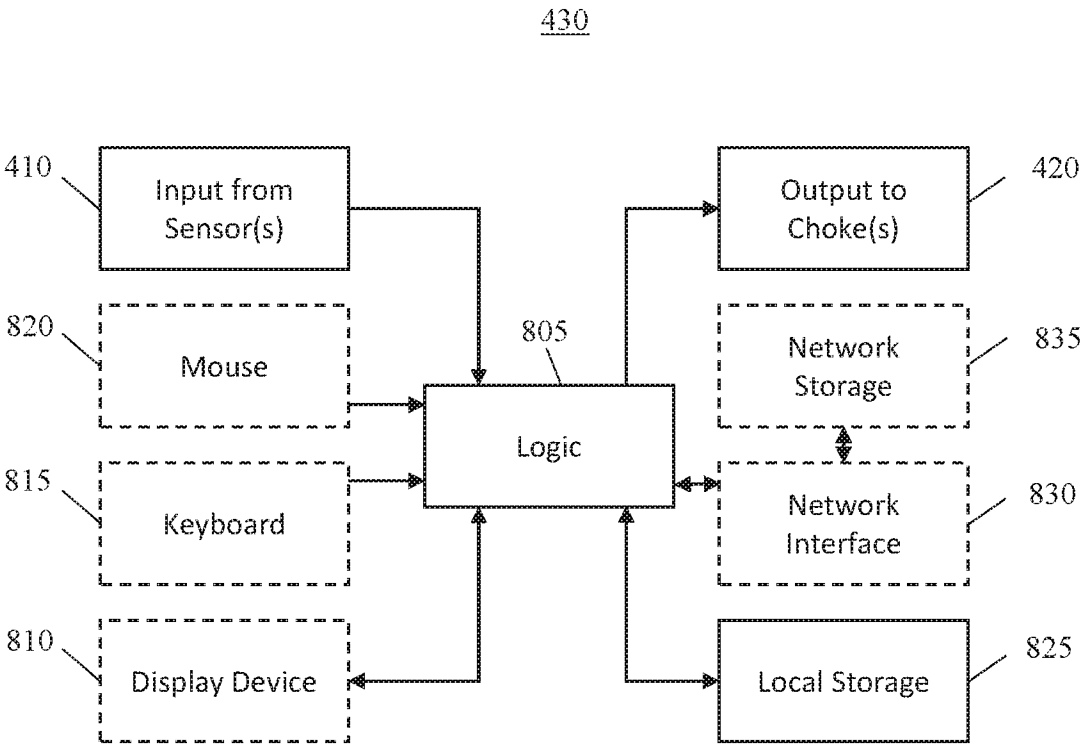
FIG. 8 shows a control system as part of the subsea drilling system for controlled delivery of unknown in accordance with one or more embodiments of the present invention.

FIG. 8 shows a control system 430 that may be configured to perform, in whole or in part, the method (e.g., 700 of FIG.

7) of controlled delivery of unknown fluids in accordance with one or more embodiments of the present invention.

Control system 430 may include one or more printed circuit boards ("PCB") on which one or more CPUs, PLCs, PLDs, and system memory may be disposed, hereinafter collectively referred to as logic 805. One of ordinary skill in the art will recognize that logic 805 may be distributed across multiple PCBs, may use one or more CPUs, PLCs, PLDs, and other devices, or combinations thereof, and may be, in whole or in part, an existing rig-based computing or controller system capable of being configured to receive input 410 from the sensor(s) (e.g., 310 and/or 320 of FIG. 3) of the instrumented mud-gas separator(s) (300 of FIG. 3) and output sensor signal(s) 420 to the one or more choke manifolds (e.g., 135*a* and 135*b*), in accordance with one or more embodiments of the present invention.

Control system 430 may include one or more input/output devices such as, for example, a display device 810, a keyboard 815, a mouse 820, or any other human-computer interface device. The one or more input/output devices may be discrete or integrated into control system 430. Display device 810 may be a touch screen that includes a touch sensor configured to sense touch. Control system 430 may receive input 410 from sensor(s) (e.g., 310 and/or 320 of FIG. 3) indicative of a state of the instrumented mud-gas separator (300 of FIG. 3) including one or more of a fluid and/or pressure level, the crossing of a threshold level, or a state of the respective instrumented mud-gas separator (300 of FIG. 3). In response, control system 430 may output sensor signal(s) 420 to the one or more choke manifold(s) (e.g., 135*a* and/or 135*b*) to modify the state of the one or more choke manifolds (e.g., 135*a* and/or 135*b*) in accordance with the programming of the logic 805 and the input it receives.

Control system 430 may include one or more local storage devices 825. Local storage device 825 may be a solid-state memory device, a solid-state memory device array, a hard disk drive, a hard disk drive array, or any other non-transitory computer readable medium. Control system 430 may include one or more interface devices 830 that provide a network, wireless, or point-to-point communications interface to control system 430. The one or more interfaces 830 supported may be Ethernet, Wi-Fi, WiMAX, Fibre Channel, Bluetooth, Bluetooth Low-Energy ("BLE"), Radio Frequency Identification ("RFID"), Near-Field Communications ("NFC"), or any other network, wireless, or point-to-point interface suitable to facilitate networked, wireless, and/or point-to-point communications.

Control system 430 may include one or more network-attached storage devices 835 in addition to, or instead of, one or more local storage devices 825. Network-attached storage device 835 may be a solid-state memory device, a solid-state memory device array, a hard disk drive, a hard disk drive array, or any other non-transitory computer readable medium. Network-attached storage device 835 may not be collocated with control system 430 and may be accessible to control system 430 via one or more interfaces 830 and may include cloud-based storage.

One of ordinary skill in the art will recognize that control system 430 may be an application-specific stand-alone computing or control system, an existing rig-based computing or control system, a part of an existing rig-based computing or control system, or any other type of computing or control system capable of receiving input 410 and outputting sensor signal(s) 420 to the one or more choke manifold(s) (e.g., 135*a* and/or 135*b*) based on the programming of the logic 805 in accordance with one or more embodiments of the present invention.

Advantages of one or more embodiments of the present invention may include one or more of the following:

In one or more embodiments of the present invention, a method and system for controlled delivery of unknown fluids uses the well control choke manifold, which is conventionally used only to manage pressure upstream of the choke manifold, for the unique purpose of controlling delivery of unknown fluids to the surface in a safe and efficient manner.

In one or more embodiments of the present invention, a method and system for controlled delivery of unknown fluids allows for the safe and efficient delivery of unknown fluids from within the wellbore and/or the marine riser to one or more instrumented mud-gas separators for safe, efficient, and expeditious removal of entrained gases.

In one or more embodiments of the present invention, a method and system for controlled delivery of unknown fluids allows for control of a well control choke manifold that governs the delivery of unknown fluids from within the wellbore and control of an MPD choke manifold that governs the delivery of unknown fluids from within the marine riser to one or more instrumented mud-gas separators.

In one or more embodiments of the present invention, a method and system for controlled delivery of unknown fluids uses one or more instrumented mud-gas separators that may include a fluid level sensor that senses the fluid level within the instrumented mud-gas separator and provides a sensor signal indicative of the fluid level to a control system that may be configured to intelligently govern the delivery of unknown fluids from within the wellbore and/or the riser.

In one or more embodiments of the present invention, a method and system for controlled delivery of unknown fluids includes a control system that may be configured to independently govern the delivery of unknown fluids from within the wellbore and/or the marine riser in a manner that does not swamp, or overload, the one or more instrumented mud-gas separators. The controlled delivery allows for the independent removal of the unknown fluids in a safe and efficient manner that may give preference to removal from within the wellbore or from within the marine riser depending on the location and amount of unknown fluids suspected to contain gas.

In one or more embodiments of the present invention, a method and system for controlled delivery of unknown fluids allows for the determination of the presence of unknown fluids in one or more of the wellbore and/or the riser and provides for the independent and controlled delivery of the unknown fluids in manner that emphasizes safety, giving preference to removal from within the wellbore or from within the riser depending on the location and amount of unknown fluids suspected to contain gas.

In one or more embodiments of the present invention, a method and system for controlled delivery of unknown fluids improves the safety of drilling and subsea drilling systems over conventional subsea drilling systems.

In one or more embodiments of the present invention, a method and system for controlled delivery of unknown fluids improves the reliability of subsea drilling systems over conventional subsea drilling systems.

In one or more embodiments of the present invention, a method and system for controlled delivery of unknown fluids improves the productivity of subsea drilling systems over conventional subsea drilling systems.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A drilling system for controlled delivery of unknown fluids comprising:

a blowout preventer comprising a wellbore fluid return line that directs unknown wellbore fluids to a choke manifold;

an instrumented mud-gas separator that receives unknown wellbore fluids from the choke manifold, the instrumented mud-gas separator comprising a sensor that outputs a sensor signal indicative of a state of the instrumented mud-gas separator; and a control system that controls a state of the choke manifold that directs unknown wellbore fluids to the instrumented mud-gas separator based on the sensor signal to maximize a flow rate of the unknown wellbore fluids to the instrumented mud-gas separator while maintaining the instrumented mud-gas separator in an operational state.

2. The drilling system of claim 1, further comprising:

a marine riser comprising an annular closing that controllably seals the marine riser and a riser fluid return line that directs riser fluids to the choke manifold.

3. The drilling system of claim 1, wherein the sensor comprises a fluid sensor configured to sense a fluid level of the instrumented mud-gas separator and wherein the sensor signal comprises an indication of the fluid level of the instrumented mud-gas separator.

4. The drilling system of claim 1, wherein the sensor comprises a fluid sensor configured to sense one or more crossings of a threshold fluid level of the instrumented mud-gas separator and wherein the sensor signal comprises an indication of the one or more crossings of the threshold fluid level of the instrumented mud-gas separator.

5. The drilling system of claim 1, wherein the sensor comprises a fluid sensor configured to sense an operational state of the instrumented mud-gas separator and wherein the sensor signal comprises an indication of the operational state of the instrumented mud-gas separator.

6. The drilling system of claim 1, wherein the control system opens the choke manifold fully or incrementally until fully opened if a fluid level of the instrumented mud-gas separator is within an operational range.

7. The drilling system of claim 1, wherein the control system closes the choke manifold in a stepwise incremental manner, or multiple thereof, if a fluid level of the instrumented mud-gas separator is within an overload protection range or an underload protection range.

8. The drilling system of claim 1, wherein the control system fully closes the choke manifold if a fluid level of the instrumented mud-gas separator meets or exceeds a critical liquid level maximum or meets or falls below a critical liquid level minimum.

9. The drilling system of claim 1, wherein the control system stops, starts, or changes a flow rate out of one or more mud pumps.

10. The drilling system of claim 1, further comprising:

a marine riser comprising an annular closing that controllably seals the marine riser and a riser fluid return line that directs unknown riser fluids to a second choke manifold, wherein the control system controls a state of the second choke manifold that directs unknown riser fluids to the instrumented mud-gas separator based on the sensor signal to maximize a flow rate of the unknown riser fluids to the instrumented mud-gas separator while maintaining the instrumented mud-gas separator in an operational state.

11. The drilling system of claim 10, wherein the control system opens the choke manifold and the second choke manifold fully or incrementally until fully opened if a fluid level of the instrumented mud-gas separator is within an operational range.

12. The drilling system of claim 10, wherein the control system closes the choke manifold and the second choke manifold in a stepwise incremental manner, or multiple thereof, if a fluid level of the instrumented mud-gas separator is within an overload protection range or an underload protection range.

13. The drilling system of claim 10, wherein the control system fully closes the choke manifold and the second choke manifold if a fluid level of the instrumented mud-gas separator meets or exceeds a critical liquid level maximum or meets or falls below a critical liquid level minimum.

14. The drilling system of claim 10, wherein the control system opens one of the choke manifold or the second choke manifold fully or incrementally until fully opened if a fluid level of the instrumented mud-gas separator is within an operational range based on input that fluids believed to contain gas are in either the wellbore or the marine riser.

15. The drilling system of claim 10, wherein the control system opens each of the choke manifold and the second choke manifold in a stepwise incremental manner, or multiple thereof, if a fluid level of the instrumented mud-gas separator is within an operational range, wherein a step size is adjusted to favor removal of fluids from either the wellbore or the marine riser.

16. The drilling system of claim 1, further comprising:

a marine riser comprising an annular closing that controllably seals the marine riser and a riser fluid return line that directs unknown riser fluids to a second choke manifold; and a second instrumented mud-gas separator that receives unknown riser fluids from the second choke manifold, the second instrumented mud-gas separator comprising a second sensor that outputs a second sensor signal indicative of a state of the second instrumented mud-gas separator, wherein the control system controls a state of the second choke manifold that directs unknown riser fluids to the second instrumented mud-gas separator based on the second sensor signal to maximize a flow rate of the unknown riser fluids to the second instrumented mud-gas separator while maintaining the second instrumented mud-gas separator in an operational state.

17. The drilling system of claim 16, wherein the control system opens the second choke manifold fully or incrementally until fully opened if a fluid level of the second instrumented mud-gas separator is within an operational range.

18. The drilling system of claim 16, wherein the control system closes the second choke manifold in a stepwise incremental manner, or multiple thereof, if a fluid level of the second instrumented mud-gas separator is within an overload protection range or an underload protection range.

19. The drilling system of claim 16, wherein the control system fully closes the second choke manifold if a fluid level of the second instrumented mud-gas separator meets or exceeds a critical liquid level maximum or meets or falls below a critical liquid level minimum.

20. The drilling system of claim 1, further comprising:

a shale shaker that receives fluids from the instrumented mud-gas separator and removes solids and cuttings from the fluids.

21. A method of controlled delivery of unknown fluids comprising:

receiving, by a control system, a sensor signal from an instrumented mud-gas separator, wherein the sensor signal is indicative of a state of the instrumented mud-gas separator; and controlling a state of a choke manifold that directs unknown fluids to the instrumented mud-gas separator based on the sensor signal to maximize the flow rate of the unknown fluids to the instrumented mud-gas separator while maintaining the instrumented mud-gas separator in an operational state.

22. The method of claim 21, wherein the control system opens the choke manifold fully or incrementally until fully opened if a fluid level of the instrumented mud-gas separator is within an operational range.

23. The method of claim 21, wherein the control system closes the choke manifold in a stepwise incremental manner, or multiple thereof, if a fluid level of the instrumented mud-gas separator is within an overload protection range or an underload protection range.

24. The method of claim 21, wherein the control system fully closes the choke manifold if a fluid level of the instrumented mud-gas separator meets or exceeds a critical liquid level maximum or meets or falls below a critical liquid level minimum.

25. The method of claim 21, wherein the control system stops, starts, or changes a flow rate out of one or more mud pumps depending on an operation being conducted.

26. The method of claim 21, further comprising:

controlling a state of a second choke manifold that directs unknown fluids to the instrumented mud-gas separator based on the sensor signal to maximize a flow rate of the unknown fluids to the instrumented mud-gas separator while maintaining the instrumented mud-gas separator in an operational state.

27. The method of claim 26, wherein the control system opens the second choke manifold fully or incrementally until fully opened if a fluid level of the instrumented mud-gas separator is within an operational range.

28. The method of claim 26, wherein the control system closes the second choke manifold in a stepwise incremental manner, or multiple thereof, if a fluid level of the instrumented mud-gas separator is within an overload protection range or an underload protection range.

29. The method of claim 26, wherein the control system fully closes the second choke manifold if a fluid level of the instrumented mud-gas separator meets or exceeds a critical liquid level maximum or meets or falls below a critical liquid level minimum.

30. The method of claim 26, wherein the control system opens one of the choke manifold or the second choke manifold fully or incrementally until fully opened if a fluid level of the instrumented mud-gas separator is within an operational range based on input that fluids believed to contain gas are in either a wellbore or a marine riser.

31. The method of claim 26, wherein the control system opens each of the choke manifold and the second choke manifold in a stepwise incremental manner if a fluid level of the instrumented mud-gas separator is within an operational range, wherein a step size is adjusted to favor removal of fluids from either a wellbore or a marine riser.

32. The method of claim 21, further comprising:

receiving, by the control system, a second sensor signal from a second instrumented mud-gas separator, wherein the second sensor signal is indicative of a state of the second instrumented mud-gas separator; and controlling a state of a second choke manifold that directs unknown fluids to the second instrumented mud-gas separator based on the sensor signal to maximize the flow rate of the unknown fluids to the instrumented mud-gas separator while maintaining the instrumented mud-gas separator in an operational state.

33. The method of claim 32, wherein the control system opens the second choke manifold fully or incrementally until fully opened if a fluid level of the second instrumented mud-gas separator is within an operational range.

34. The method of claim 32, wherein the control system closes the second choke manifold in a stepwise incremental manner, or multiple thereof, if a fluid level of the second instrumented mud-gas separator is within an overload protection range or an underload protection range.

35. The method of claim 32, wherein the control system fully closes the second choke manifold if a fluid level of the second instrumented mud-gas separator meets or exceeds a critical liquid level maximum or meets or falls below a critical liquid level minimum.

* * * * *